US010427176B2

(12) United States Patent
Mareli et al.

(10) Patent No.: US 10,427,176 B2
(45) **Date of Patent: *Oct. 1, 2019**

(54) IRRIGATION SPRINKLER

(71) Applicant: NAANDANJAIN IRRIGATION LTD., Kibbutz Naan (IL)

(72) Inventors: Lior Eliahu Mareli, Rehovot (IL); Eli Armon, Even-Yehuda (IL)

(73) Assignee: NAANDANJAIN IRRIGATION LTD., Kibbutz Naan (IL)

( * ) Notice: Subject to any disclaimer, the term of this patent is extended or adjusted under 35 U.S.C. 154(b) by 0 days.

This patent is subject to a terminal disclaimer.

(21) Appl. No.: 15/857,397

(22) Filed: Dec. 28, 2017

(65) Prior Publication Data

US 2018/0169676 A1 Jun. 21, 2018

Related U.S. Application Data

(63) Continuation of application No. 15/480,548, filed on Apr. 6, 2017, now Pat. No. 9,895,705, which is a (Continued)

(51) Int. Cl.
*B05B 3/04* (2006.01)
*B05B 1/02* (2006.01)

(52) U.S. Cl.
CPC ..... *B05B 3/0481* (2013.01); *B05B 1/02* (2013.01)

(58) Field of Classification Search
CPC ..... B05B 3/0481; B05B 1/02
(Continued)

(56) References Cited

U.S. PATENT DOCUMENTS 461,415 A 10/1891 Bonnette
581,252 A 4/1897 Quayle
(Continued)

FOREIGN PATENT DOCUMENTS

DE 2508865 9/1976
EP 2974794 1/2016
(Continued)

OTHER PUBLICATIONS

An Office Action dated Apr. 20, 2005, which issued during the prosecution of U.S. Appl. No. 10/476,082.
(Continued)

*Primary Examiner* — Arthur O. Hall
*Assistant Examiner* — Steven M Cernoch
(74) *Attorney, Agent, or Firm* — Sughrue Mion, PLLC

(57) ABSTRACT

An irrigation sprinkler including a base defining an axis, a pressurized water inlet mounted onto the base, a nozzle, communicating with the inlet, and providing a pressurized water stream which is generally outwardly directed relative to the axis and a water stream deflector for engaging the pressurized water stream and deflecting at least part of the water stream azimuthally with respect to the axis, the deflector including a first pressurized water stream engagement surface and a second pressurized water stream engagement surface downstream of the first engagement surface, the first engagement surface having a pressurized water stream directing configuration arranged to direct a first portion of the stream impinging thereon, which does not exceed a predetermined quantity, onto the second surface and to direct at least a second portion of the stream impinging thereon, which at least a second portion exceeds the predetermined quantity, not onto the second engagement surface.

8 Claims, 46 Drawing Sheets

Related U.S. Application Data continuation of application No. 14/334,887, filed on Jul. 18, 2014, now Pat. No. 9,682,386.

(58) Field of Classification Search

USPC ... 239/230, 275, 71, 74, 390, 396, 436, 443, 239/444, 498, 504, 505, 518, 520–522, 239/580, 465, DIG. 1

See application file for complete search history.

(56) References Cited

U.S. PATENT DOCUMENTS 1,577,225 A 3/1926 Granger
1,590,910 A 6/1926 William
1,593,918 A 7/1926 Stanton
1,631,874 A 6/1927 Lasher et al.
1,637,413 A 8/1927 Elder
2,025,267 A 12/1935 Buelna
2,220,275 A 11/1940 Preston
2,323,701 A 7/1943 Barksdale
2,345,030 A 3/1944 Buckner
2,421,551 A 6/1947 Dunham
2,464,958 A 3/1949 John
2,475,537 A 7/1949 Ashworth
2,565,926 A 8/1951 Manning
2,582,158 A 1/1952 Porter
2,610,089 A 9/1952 Unger
2,625,411 A 1/1953 Unger
2,654,635 A 10/1953 Lazzarini
2,694,600 A 11/1954 Richey
2,716,574 A 8/1955 Chase
2,726,119 A 12/1955 Egly et al.
2,780,488 A 2/1957 Kennedy
2,816,798 A 12/1957 Royer
2,835,529 A 5/1958 Egly et al.
2,853,342 A 9/1958 Kachergis
2,895,681 A 7/1959 Kachergis
2,904,261 A 9/1959 Johnson
2,929,597 A 3/1960 Ruggieri et al.
2,962,220 A 11/1960 Woods
2,979,271 A 4/1961 Boyden
2,989,248 A 6/1961 Norland
3,017,123 A 1/1962 Rinkewich et al.
3,019,992 A 2/1962 Zecchinato
3,022,012 A 2/1962 Sharp et al.
3,033,467 A 5/1962 Hofer
3,033,469 A 5/1962 Green
3,038,666 A 6/1962 Dudley et al.
3,082,958 A 3/1963 Thomas
3,091,399 A 5/1963 Kennedy
3,117,724 A 1/1964 Ray
3,309,025 A 3/1967 Malcolm
3,391,868 A 7/1968 Cooney
3,434,665 A 3/1969 Royer
3,464,628 A 9/1969 Chow
3,468,485 A 9/1969 Sully
3,523,647 A 8/1970 Radecki
3,532,273 A 10/1970 Siddall et al.
3,559,887 A 2/1971 Meyer
3,567,126 A 3/1971 Martini
3,581,994 A 6/1971 Heiberger
3,583,638 A 6/1971 Eby et al.
3,606,163 A 9/1971 Lewis
3,625,429 A 12/1971 Turrell
3,654,817 A 4/1972 Kane
3,726,479 A 4/1973 Leissner et al.
3,727,842 A 4/1973 Ertsgaard et al.
3,746,259 A 7/1973 Apri
3,765,608 A 10/1973 Lockwood
3,782,638 A 1/1974 Bumpstead
3,785,565 A 1/1974 Perry et al.
3,791,585 A 2/1974 Warren
3,837,576 A 9/1974 Rosenkranz
3,841,563 A 10/1974 Lockwood
3,874,588 A 4/1975 Flynn
3,884,416 A 5/1975 King
3,917,174 A 11/1975 Hildebrandt et al.
3,918,642 A 11/1975 Best
3,918,643 A 11/1975 Malcolm
3,921,912 A 11/1975 Hayes
3,930,618 A 1/1976 Lockwood
3,952,953 A 4/1976 Eby
3,955,762 A 5/1976 Cassimatis et al.
3,955,764 A 5/1976 Phaup
3,977,610 A 8/1976 Royer
3,981,452 A 9/1976 Eckstein
3,986,671 A 10/1976 Nugent
4,009,832 A 3/1977 Tiedt
4,026,471 A 5/1977 Hunter
4,055,304 A 10/1977 Munson
4,091,996 A 5/1978 Nelson
4,123,006 A 10/1978 Yukishita
4,161,286 A 7/1979 Beamer et al.
4,164,324 A 8/1979 Bruninga
4,166,580 A 9/1979 Meckel
4,177,944 A 12/1979 Wichman
4,182,494 A 1/1980 Wichman et al.
4,198,000 A 4/1980 Hunter
4,201,344 A 5/1980 Lichte
4,220,283 A 9/1980 Citron
4,225,084 A 9/1980 Bals
4,234,125 A 11/1980 Lieding
4,234,126 A 11/1980 Morgan
4,253,608 A 3/1981 Hunter
4,256,262 A 3/1981 Rosenberg
4,277,029 A 7/1981 Rabitsch
4,316,579 A 2/1982 Ray et al.
4,330,087 A 5/1982 Wood et al.
4,331,294 A 5/1982 Gilad
4,335,852 A 6/1982 Chow
4,351,477 A 9/1982 Choi
4,376,513 A 3/1983 Hagar
4,398,666 A 8/1983 Hunter
4,402,460 A 9/1983 Shavit et al.
4,417,691 A 11/1983 Lockwood
4,423,838 A 1/1984 Dinur
4,453,673 A 6/1984 Icenbice
4,457,470 A 7/1984 Hauger et al.
4,497,441 A 2/1985 Chow
4,498,626 A 2/1985 Pitchford
4,512,519 A 4/1985 Uzrad
4,514,291 A 4/1985 McGarry et al.
4,537,356 A 8/1985 Lawson
4,540,125 A 9/1985 Gorney et al.
4,565,323 A 1/1986 Berkan
4,580,724 A 4/1986 Brown et al.
4,624,412 A 11/1986 Hunter
4,625,913 A 12/1986 Christen
4,625,914 A 12/1986 Sexton et al.
4,627,549 A 12/1986 Dudding
4,632,312 A 12/1986 Premo et al.
4,637,549 A 1/1987 Schwartzman
4,669,663 A 6/1987 Meyer
4,681,260 A 7/1987 Cochran
4,702,280 A 10/1987 Zakai et al.
4,722,670 A 2/1988 Zweifel
4,754,925 A 7/1988 Rubinstein
4,760,959 A 8/1988 Gorney
4,773,595 A 9/1988 Livne
4,784,325 A 11/1988 Walker et al.
4,796,810 A 1/1989 Zakai
4,817,869 A 4/1989 Rubinstein
4,824,020 A 4/1989 Harward
4,836,449 A 6/1989 Hunter
4,836,450 A 6/1989 Hunter
4,884,749 A 12/1989 Ruprechter
4,892,252 A 1/1990 Bruninga
4,907,742 A 3/1990 Whitehead et al.
4,925,098 A 5/1990 Di Paola
4,927,082 A 5/1990 Greenberg et al.
4,944,456 A 7/1990 Zakai
4,966,328 A 10/1990 Neeman
4,972,993 A 11/1990 Van Leeuwen
4,978,070 A 12/1990 Chow
4,984,740 A 1/1991 Hodge

(56) References Cited

U.S. PATENT DOCUMENTS

| | | | |
|---|---|---|---|
| 5,031,833 | A | 7/1991 | Alkalay et al. |
| 5,031,835 | A | 7/1991 | Rojas |
| 5,048,757 | A | 9/1991 | Van Leeuwen |
| 5,052,620 | A | 10/1991 | Rinkewich |
| 5,058,806 | A | 10/1991 | Rupar |
| RE33,823 | E | 2/1992 | Nelson et al. |
| 5,115,977 | A | 5/1992 | Alkalay et al. |
| 5,172,864 | A | 12/1992 | Spencer |
| 5,192,024 | A | 3/1993 | Blee |
| 5,238,188 | A | 8/1993 | Lerner et al. |
| 5,240,182 | A | 8/1993 | Lemme |
| 5,372,307 | A | 12/1994 | Sesser |
| 5,544,814 | A | 8/1996 | Spenser |
| 5,641,122 | A | 6/1997 | Alkalai et al. |
| 5,642,861 | A | 7/1997 | Ogi et al. |
| 5,647,541 | A | 7/1997 | Nelson |
| 5,762,269 | A | 6/1998 | Sweet |
| 5,836,516 | A | 11/1998 | Van Epps et al. |
| 5,950,927 | A | 9/1999 | Elliot et al. |
| 5,971,297 | A | 10/1999 | Sesser |
| 6,016,972 | A | 1/2000 | Kantor et al. |
| 6,145,758 | A | 11/2000 | Ogi et al. |
| 6,158,675 | A | 12/2000 | Ogi |
| 6,322,027 | B1 | 11/2001 | Hsu |
| 7,014,125 | B2 | 3/2006 | Lerner |
| 9,682,386 | B2 | 6/2017 | Mareli et al. |
| 9,895,705 | B2 | 2/2018 | Mareli et al. |
| 2003/0129043 | A1 | 7/2003 | Clare et al. |
| 2004/0164177 | A1 | 8/2004 | Lerner |
| 2012/0153096 | A1 | 6/2012 | Shaol et al. |
| 2016/0016184 | A1 | 1/2016 | Mareli et al. |
| 2017/0209879 | A1 | 7/2017 | Mareli et al. |

FOREIGN PATENT DOCUMENTS

| | | |
|---|---|---|
| GB | 846181 | 8/1960 |
| GB | 1389971 | 4/1975 |
| GB | 1463276 | 2/1977 |
| GB | 1479409 | 7/1977 |
| GB | 1489001 | 10/1977 |
| GB | 1509564 | 5/1978 |
| GB | 2043417 | 10/1980 |
| GB | 1578242 | 11/1980 |
| GB | 2051533 | 1/1981 |
| GB | 2138705 | 10/1984 |
| IL | 43357 | 8/1975 |
| WO | 95/31288 | 11/1995 |
| WO | 02/085529 | 10/2002 |
| WO | 2010/013243 | 2/2010 |

OTHER PUBLICATIONS

An Office Action dated May 10, 2013, which issued during the prosecution of U.S. Appl. No. 12/836,328.

An Office Action dated Nov. 21, 2013, which issued during the prosecution of U.S. Appl. No. 12/836,328.

An Office Action dated Apr. 10, 2014, which issued during the prosecution of U.S. Appl. No. 13/476,434.

Notice of Allowance dated Oct. 21, 2005, which issued during the prosecution of U.S. Appl. No. 10/476,082.

Notice of Allowance dated Feb. 27, 2017, which issued during the prosecution of U.S. Appl. No. 14/334,887.

An Office Action dated Mar. 11, 2016, which issued during the prosecution of U.S. Appl. No. 14/334,887.

An Office Action dated Oct. 5, 2015, which issued during the prosecution of U.S. Appl. No. 14/334,887.

An Office Action dated Sep. 28, 2016, which issued during the prosecution of U.S. Appl. No. 14/334,887.

European Search Report dated Dec. 15, 2015, which issued during the prosecution of Applicant's European App No. 15173813.5.

An Office Action dated Jul. 11, 2017, which issued during the prosecution of U.S. Appl. No. 15/480,548.

Notice of Allowance dated Dec. 4, 2017, which issued during the prosecution of U.S. Appl. No. 15/480,548.

An Office Action dated Mar. 16, 2018, which issued during the prosecution of European Patent Application No. 15173813.5.

IRRIGATION SPRINKLER

CROSS REFERENCE TO RELATED APPLICATIONS

The present application is a continuation application of U.S. patent application Ser. No. 15/480,548, filed Apr. 6, 2017, which is a continuation application of U.S. patent application Ser. No. 14/334,887, filed Jul. 18, 2014 (now U.S. Pat. No. 9,682,386), entitled IRRIGATION SPRINKLER, the disclosures of which are hereby incorporated by reference.

FIELD OF THE INVENTION

The present invention relates to irrigation sprinklers and more particularly to sprinklers, which are driven for rotation about a vertical axis by an output water stream which impacts on a sprinkler element.

BACKGROUND OF THE INVENTION

Various types of impact sprinklers are known in the art.

SUMMARY OF THE INVENTION

The present invention seeks to provide an improved irrigation sprinkler.

There is thus provided in accordance with a preferred embodiment of the present invention an irrigation sprinkler including a base defining an axis, a pressurized water inlet mounted onto the base, a nozzle, communicating with the inlet, and providing a pressurized water stream which is generally outwardly directed relative to the axis and a water stream deflector for engaging the pressurized water stream from the nozzle and deflecting at least part of the water stream generally azimuthally with respect to the axis, the water stream deflector including a first pressurized water stream engagement surface and a second pressurized water stream engagement surface downstream of the first pressurized water stream engagement surface, the first pressurized water stream engagement surface having a pressurized water stream directing configuration arranged to direct a first portion of the pressurized water stream impinging on the first pressurized water stream engagement surface, which does not exceed a predetermined water stream quantity, onto the second pressurized water stream engagement surface and to direct at least a second portion of the pressurized water stream impinging on the first pressurized water stream engagement surface, which at least a second portion exceeds the predetermined water stream quantity, not onto the second pressurized water stream engagement surface.

Preferably, the nozzle is selectable to provide a selectable water stream quantity which may be less than, equal to or greater than the predetermined water stream quantity.

In accordance with a preferred embodiment of the present invention, the pressurized water stream directing configuration of the first pressurized water stream engagement surface includes at least one vane which divides the pressurized water stream into the first portion of the pressurized water stream and the at least a second portion of the pressurized water stream. Additionally, the at least one vane includes a plurality of vanes, which divide the pressurized water stream into the first portion of the pressurized water stream and a plurality of second portions of the pressurized water stream. Alternatively or alternatively, the at least one vane has a generally triangular cross section.

Preferably, the second pressurized water stream engagement surface has at least one water stream bypass aperture formed therein and the first pressurized water stream engagement surface is arranged to direct the at least a second portion of the pressurized water stream impinging on the first pressurized water stream engagement surface through the at least one water stream bypass aperture.

In accordance with a preferred embodiment of the present invention, the second pressurized water stream engagement surface is configured to be impinged upon generally only by the first portion of the pressurized water stream and the first pressurized water stream engagement surface is arranged to direct the at least a second portion of the pressurized water stream impinging on the first pressurized water stream engagement surface away from the second pressurized water stream engagement surface.

Preferably, the pressurized water stream directing configuration of the first pressurized water stream engagement surface includes at least one channel through which passes the pressurized water stream. In accordance with a preferred embodiment of the present invention, the at least one channel includes a pair of vanes which are joined by an integrally formed top plate. Additionally or alternatively, the at least one channel has an at least partially curved cross section. In accordance with a preferred embodiment of the present invention, the at least one channel has a generally triangular cross section.

In accordance with a preferred embodiment of the present invention, the first pressurized water stream engagement surface includes at least one vane which divides the pressurized water stream into the first portion of the pressurized water stream and the at least a second portion of the pressurized water stream, the second pressurized water stream engagement surface has at least one water stream bypass aperture formed therein by at least one vane, the first pressurized water stream engagement surface is arranged to direct the at least a second portion of the pressurized water stream impinging on the first pressurized water stream engagement surface through the at least one water stream bypass aperture and the at least one vane which defines the at least one water stream bypass aperture and the at least one vane which divides the pressurized water stream on the first pressurized water stream engagement surface are formed as generally collinear continuations of each other.

Preferably, the irrigation sprinkler also includes at least one intermediate vane spanning both the first and the second pressurized water stream engagement surfaces and joining the at least one vane which define the at least one water stream bypass aperture and the at least one vane which divides the pressurized water stream on the first pressurized water stream engagement surface.

In accordance with a preferred embodiment of the present invention, the second pressurized water stream engagement surface downstream of the first pressurized water stream engagement surface is curved. Preferably, the first pressurized water stream engagement surface is generally planar and the second pressurized water stream engagement surface downstream of the first pressurized water stream engagement surface is curved.

BRIEF DESCRIPTION OF THE DRAWINGS

The present invention will be understood and appreciated more fully from the following detailed description, taken in conjunction with the drawings in which.

DETAILED DESCRIPTION OF PREFERRED EMBODIMENTS

Figure 1A:
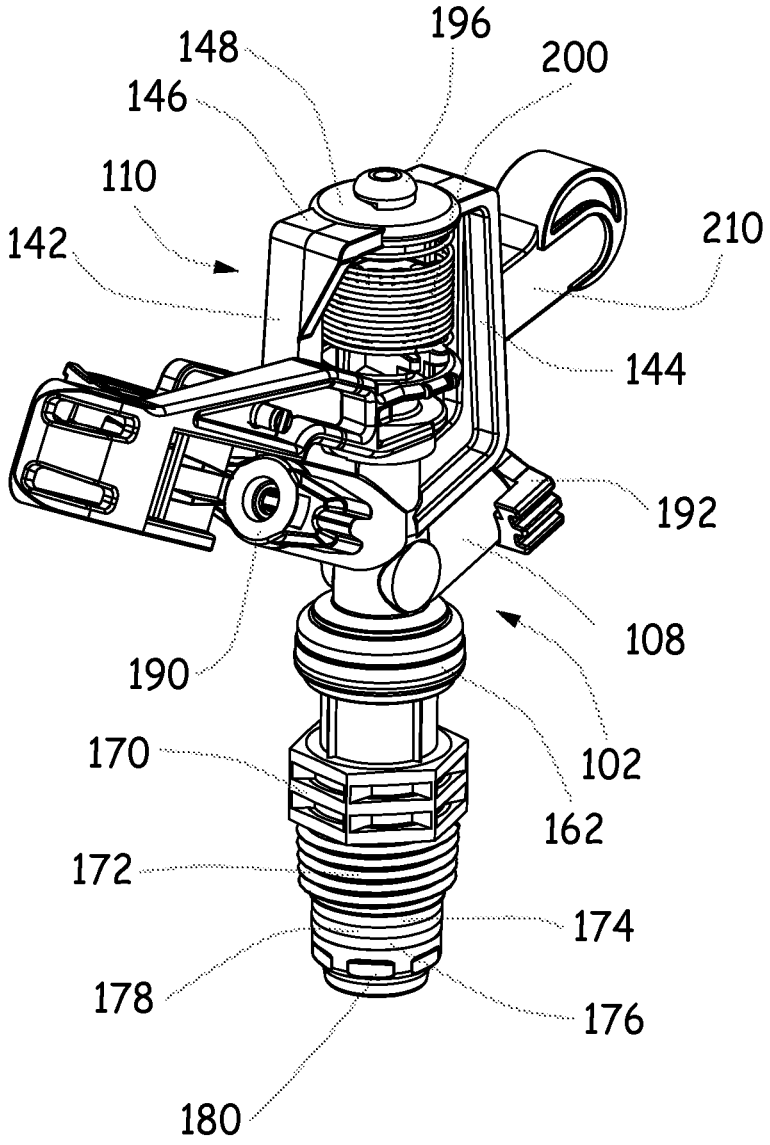
FIGS. 1A, 1B, 1C and 1D are simplified isometric illustrations, taken from four different viewpoints, of an assembled sprinkler constructed and operative in accordance with a preferred embodiment of the present invention.
Figure 1B:
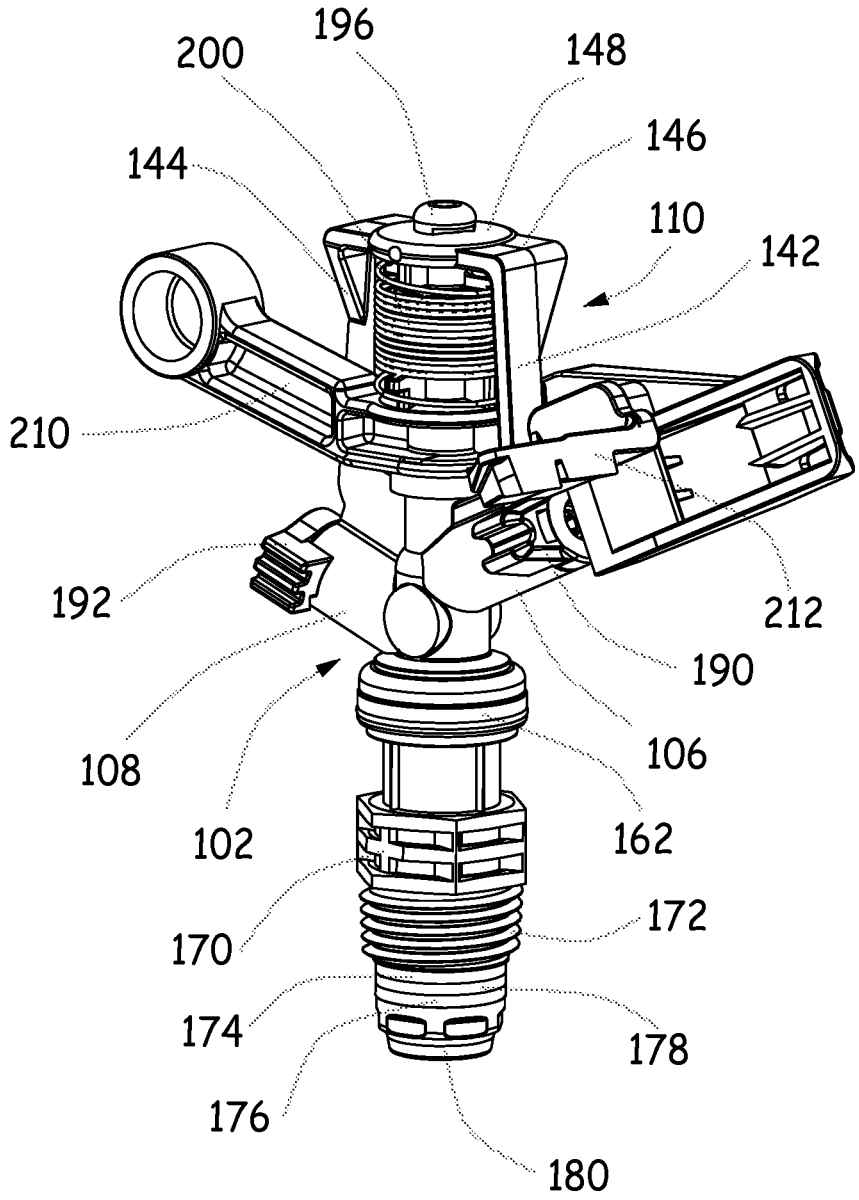
Figure 1C:
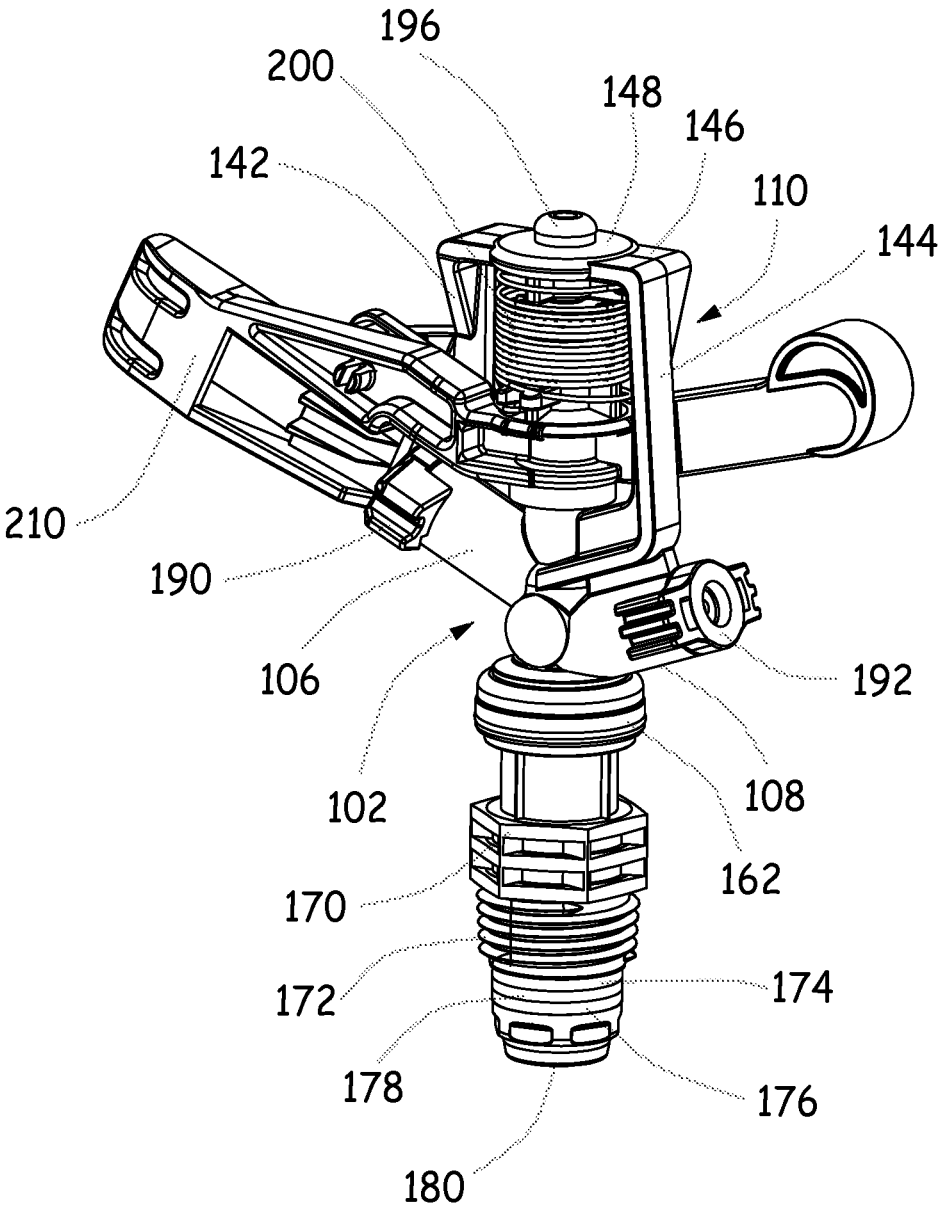
Figure 1D:
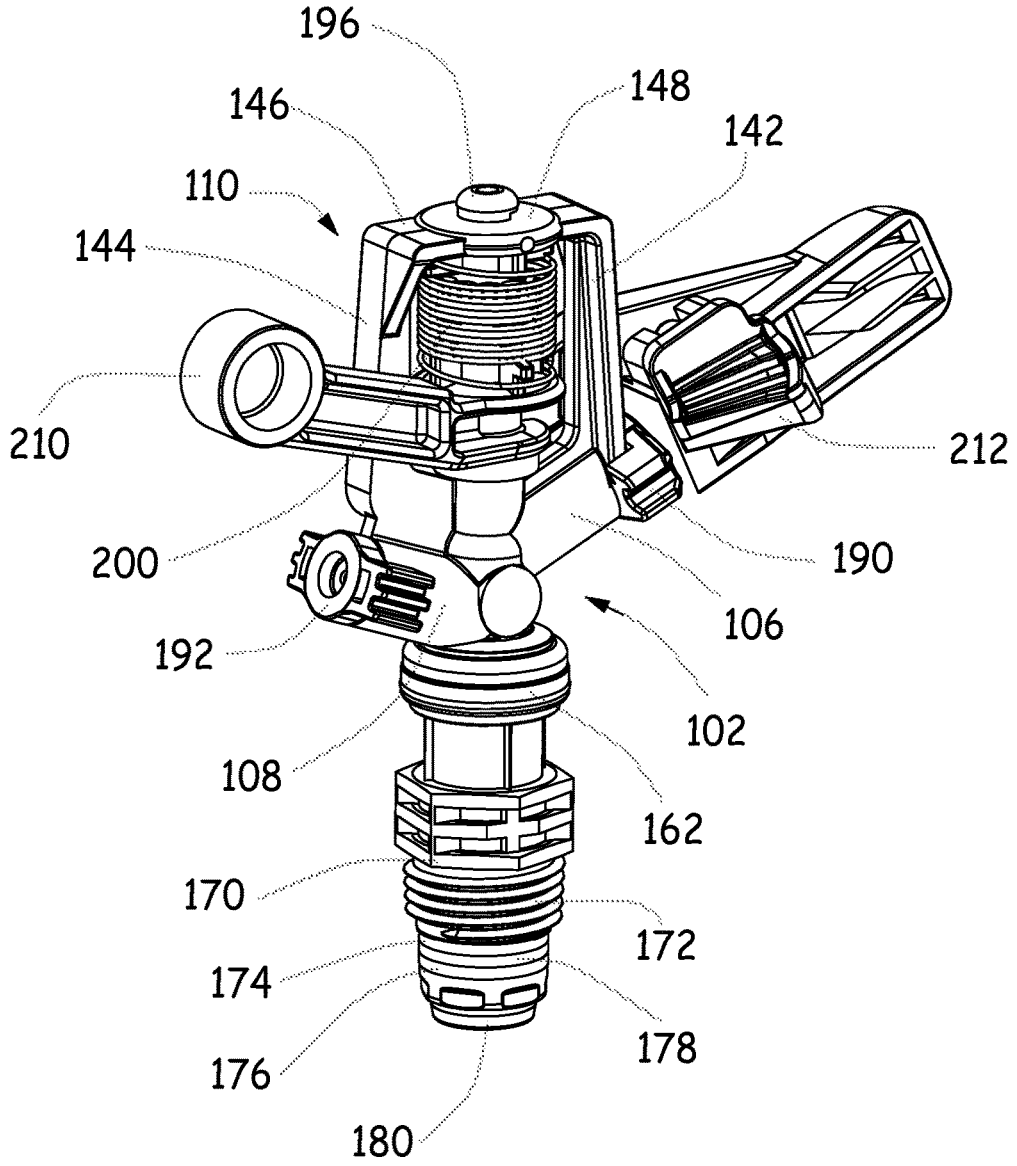
Figure 2A:
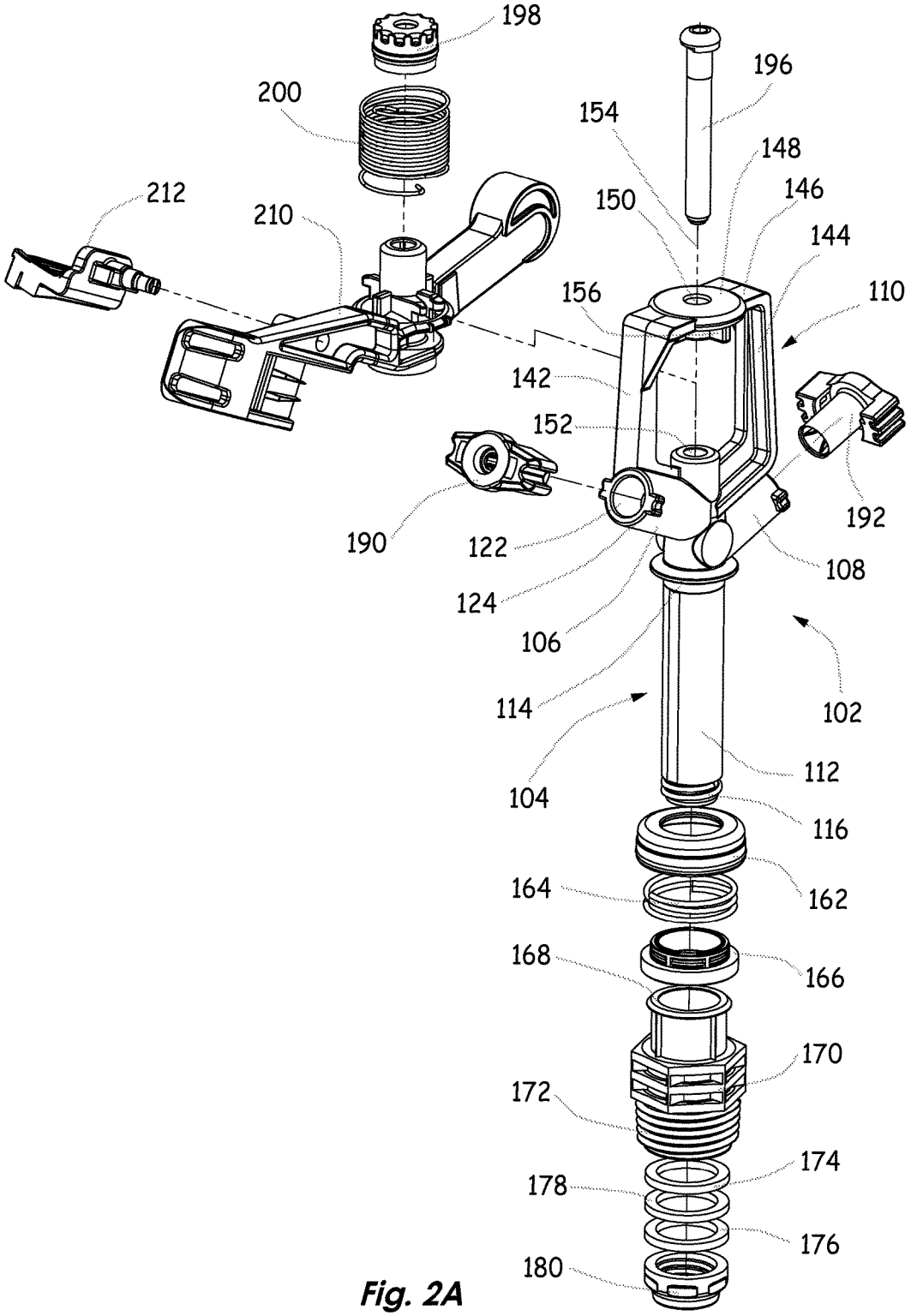
FIGS. 2A and 2B are simplified exploded view illustrations, taken from two different viewpoints, of the sprinkler of FIGS. 1A-1D.
Figure 2B:
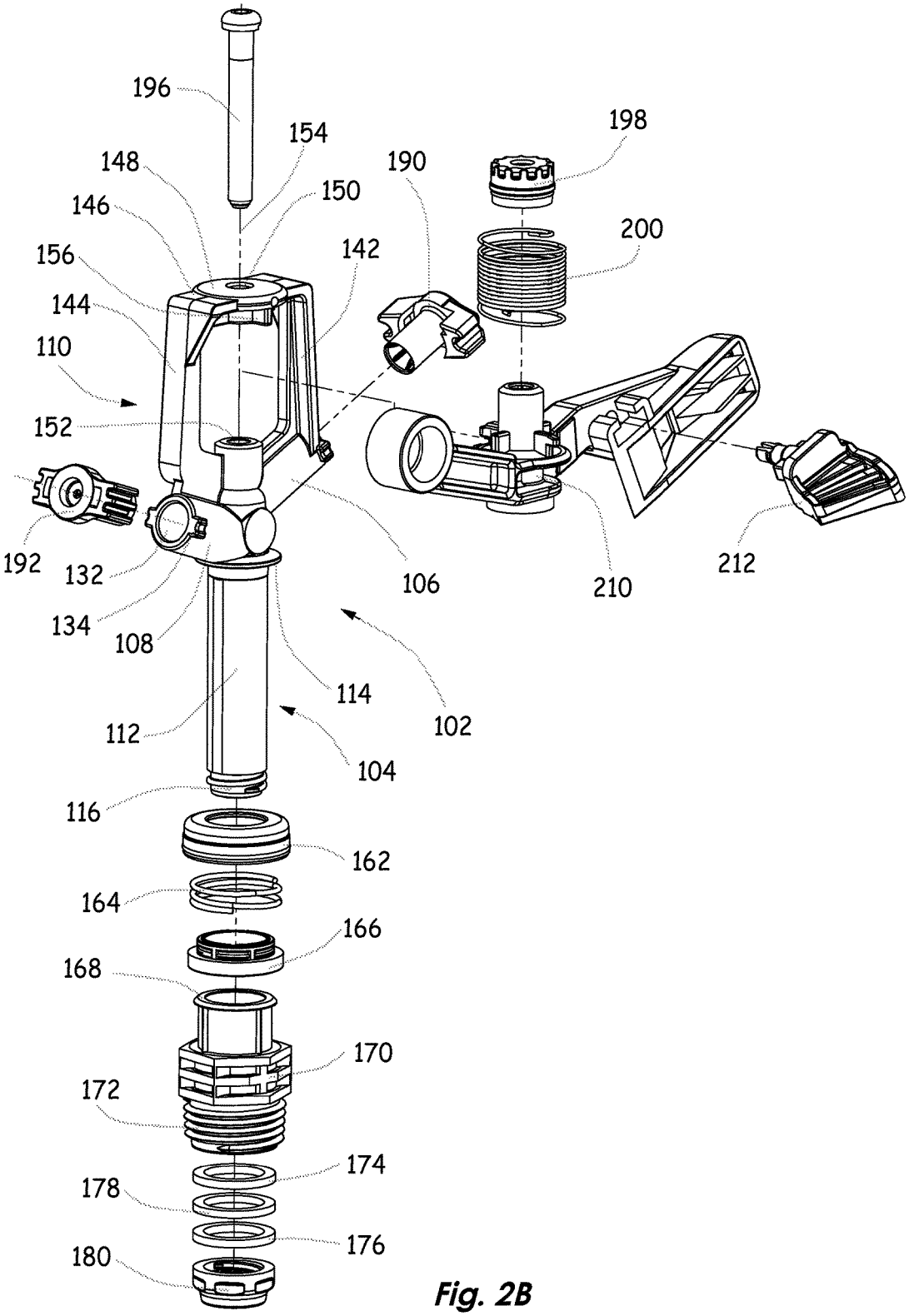

Reference is made to FIGS. 1A, 1B, 1C and 1D, which are simplified isometric illustrations, taken from four different viewpoints, of an assembled sprinkler constructed and operative in accordance with a preferred embodiment of the present invention, and to FIGS. 2A and 2B, which are simplified exploded view illustrations, taken from two different viewpoints, of the sprinkler of FIGS. 1A-1D.

As seen in FIGS. 1A-2B, the sprinkler comprises a sprinkler body 102 including a riser portion 104, a forward nozzle mounting portion 106, a rearward nozzle mounting portion 108 and a bridge portion 110.

Riser portion 104 preferably includes a generally hollow cylindrical portion 112, a top flange portion 114 and a bottom threaded portion 116.

Forward nozzle mounting portion 106 preferably includes a radially extending and upwardly extending generally hollow cylindrical portion 122, which communicates with the interior of generally hollow cylindrical portion 112, and a pair of nozzle mounting protrusions 124 on an upwardly and radially outward edge of cylindrical portion 122.

Rearward nozzle mounting portion 108 preferably includes a radially extending and upwardly extending generally hollow cylindrical portion 132, which communicates with the interior of generally hollow cylindrical portion 112, and a pair of nozzle mounting protrusions 134 on an upwardly and radially outward edge of cylindrical portion 132.

Bridge portion 110 preferably includes a pair of upwardly extending arms 142 and 144, which support a joining portion 146 defining a flange 148 having a central aperture 150 which is spaced from a corresponding recess 152 along a vertical axis 154. Underlying flange 148 there are provided a plurality of, typically four, spring mounting protrusions 156.

As seen most clearly in FIGS. 2A & 2B, mounted on riser portion 104 are multiple elements, which are here described in physical descending order from the element which lies below and against top flange portion 114. A sand protection sleeve 162 encloses a compressed thrust spring 164. A thrust spring seat 166 underlies spring 164 and overlies and partially surrounds a top flange 168 of a threaded connector base 170. Connector base 170 is formed with an outer threaded bottom portion 172, which serves for mounting of the entire sprinkler. A plurality of washers, typically including a two rubber washers 174 and 176 and an intermediate low friction washer 178, are retained about riser cylindrical portion 112 by an apertured retaining cap 180, which is threaded onto bottom threaded portion 116 of riser 104.

A selectable size forward nozzle 190 is replaceably mounted onto forward nozzle mounting portion 106 and retained thereon by engagement with nozzle mounting protrusions 124.

A selectable size rearward nozzle 192 is replaceably mounted onto rearward nozzle mounting portion 108 and is retained thereon by engagement with nozzle mounting protrusions 134. Alternatively a plug (not shown) may replace the selectable rearward nozzle 192.

A vertical hammer mounting shaft 196 is preferably mounted along vertical axis 154 and extends through aperture 150 and is seated in recess 152. Disposed about shaft 196 is a hammer sand protection sleeve 198 and a drive spring 200, which is mounted at one end thereon onto four spring mounting protrusions 156.

A hammer 210 is rotatably mounted onto shaft 196. Various embodiments of hammers are described hereinbelow in detail. A spray diffuser 212 may optionally be mounted on hammer 210.

Figure 3A:
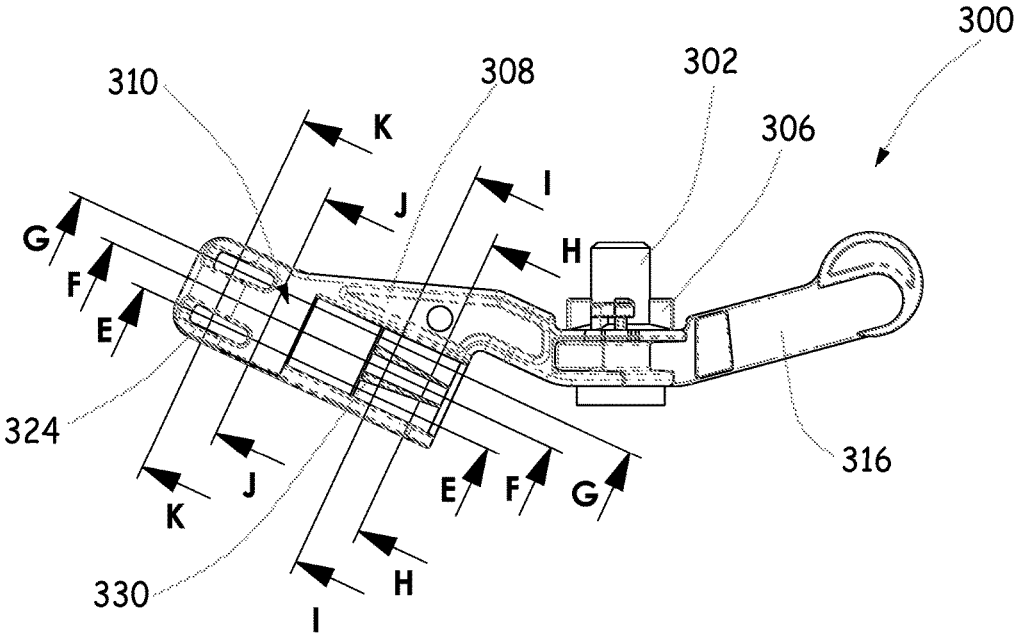
FIGS. 3A and 3B are simplified side view illustrations of a hammer element forming part of the sprinkler of FIGS. 1A-1D, 2A & 2B, FIGS. 3A & 3B being mutually rotated by 180 degrees.
Figure 3B:
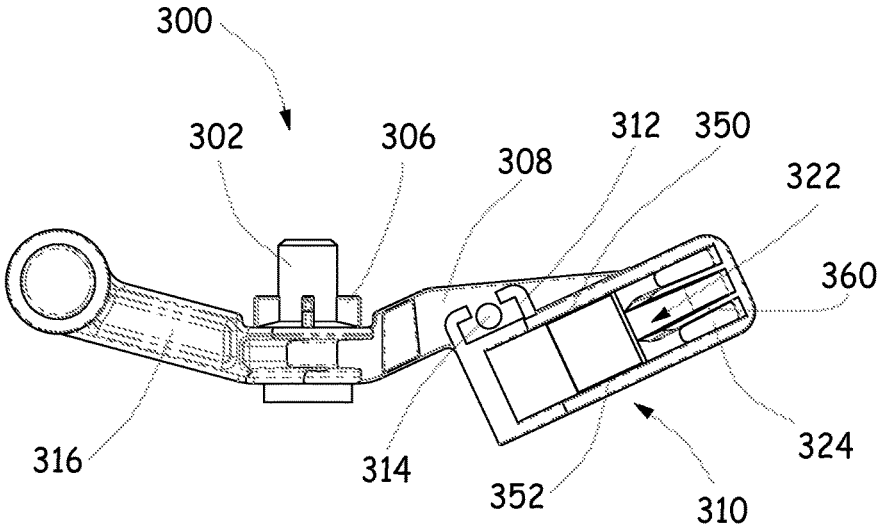
Figure 3C:
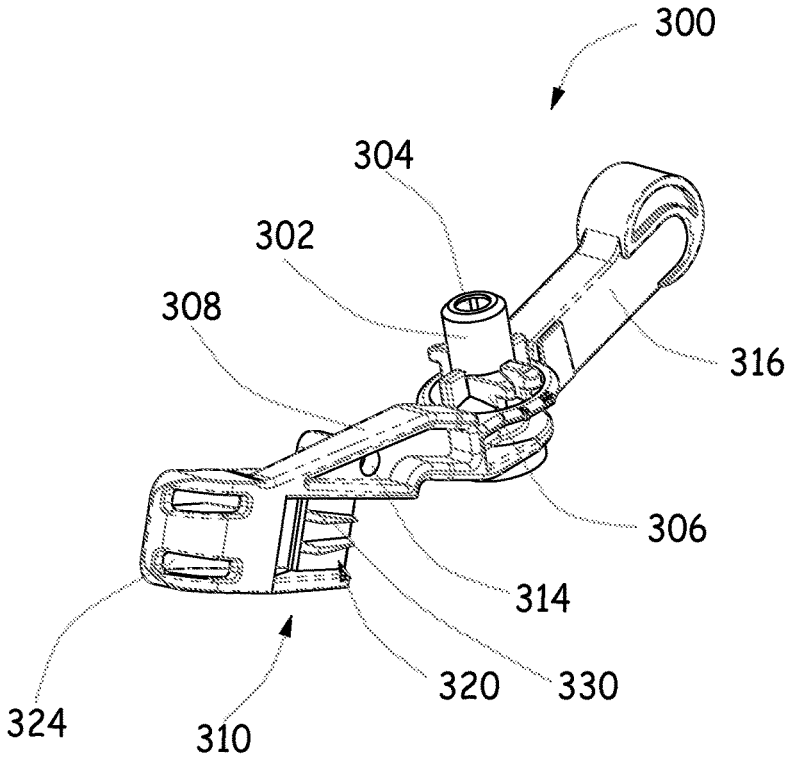
FIGS. 3C and 3D are simplified isometric illustrations of the hammer element of FIGS. 3A and 3B, taken from two different viewpoints.
Figure 3D:
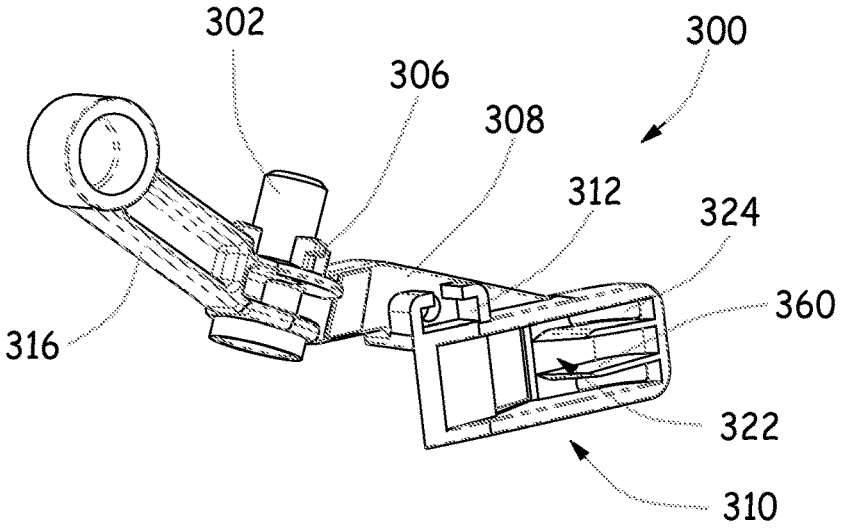
Figure 3E:
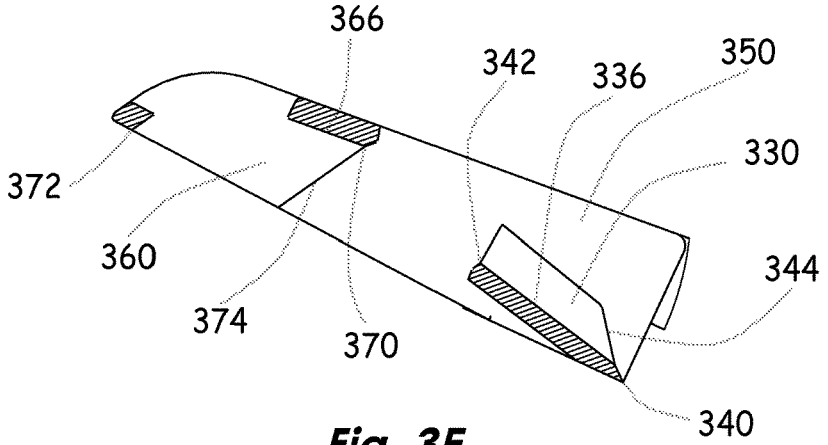
FIGS. 3E, 3F and 3G are simplified sectional illustrations taken along respective section lines E-E, F-F and G-G in FIG. 3A.
Figure 3F:
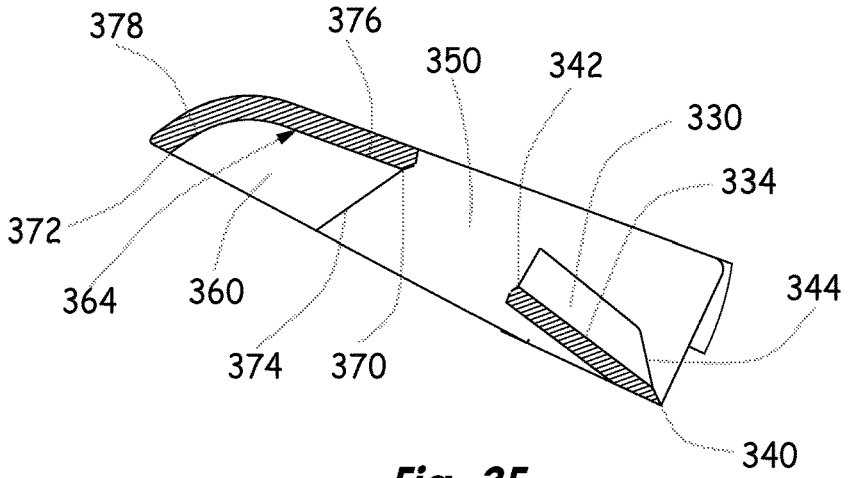
Figure 3G:
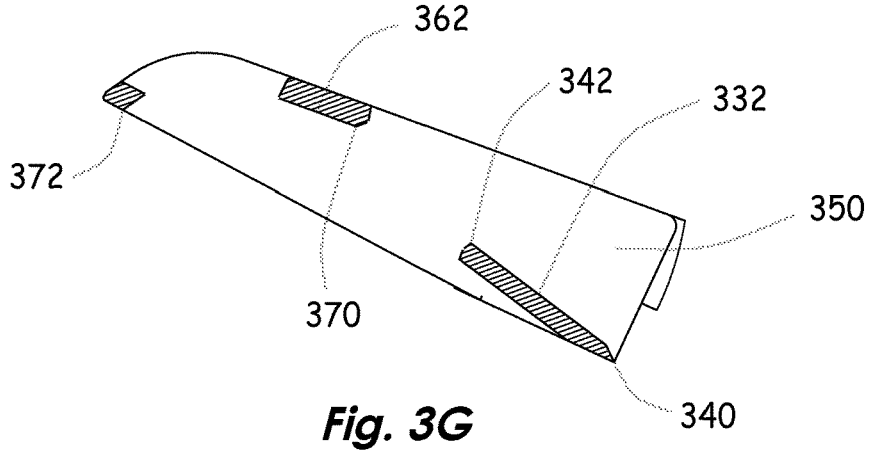
Figure 3H:
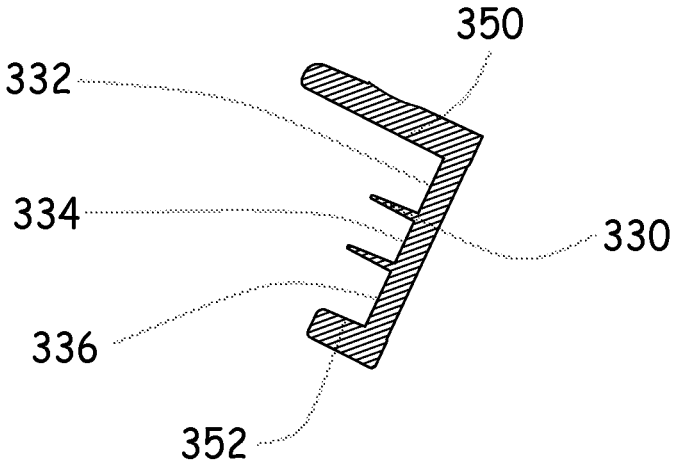
FIGS. 3H, 3I, 3J and 3K are simplified sectional illustrations taken along respective section lines H-H, I-I, J-J and K-K in FIG. 3A.
Figure 3I:
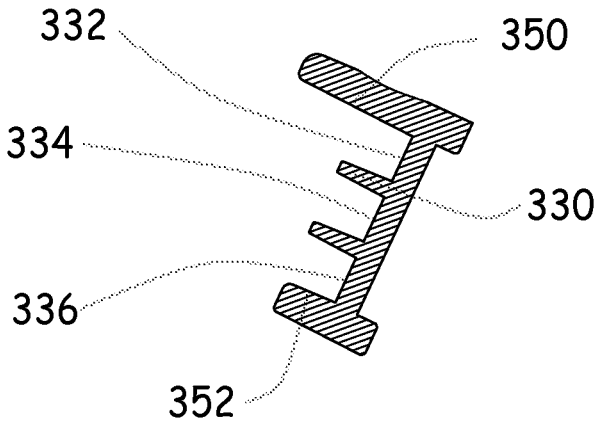
Figure 3J:
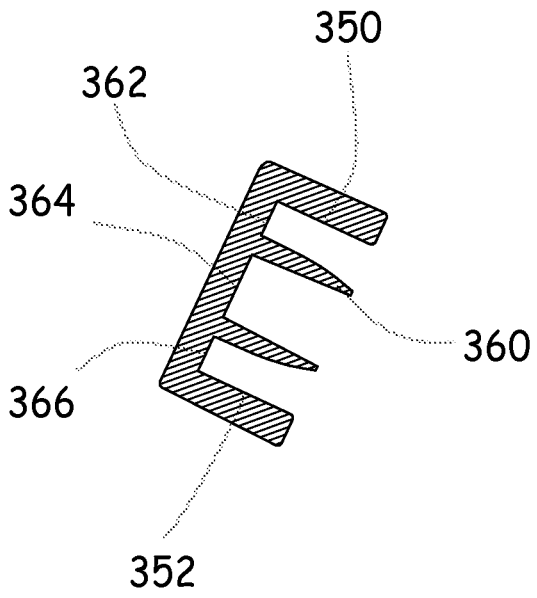
Figure 3K:
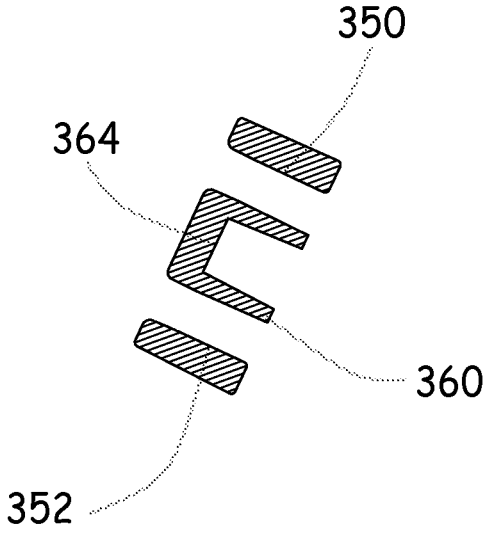

Reference is now made to FIGS. 3A and 3B, which are simplified side view illustrations of a hammer element 300 forming part of the sprinkler of FIGS. 1A-2B, FIGS. 3A & 3B being mutually rotated by 180 degrees, and to FIGS. 3C and 3D, which are simplified isometric illustrations of the hammer element of FIGS. 3A and 3B, taken from two different viewpoints. Reference is also made to FIGS. 3E, 3F and 3G, which are simplified sectional illustrations taken along respective section lines E-E, F-F and G-G in FIG. 3A, and to FIGS. 3H, 3I, 3J and 3K, which are simplified sectional illustrations taken along respective section lines H-H, I-I, J-J and K-K in FIG. 3A.

As seen in FIGS. 3A-3K, hammer 300 preferably includes a generally central hub portion 302 that defines a cylindrical sleeve portion 304 which is preferably sized to rotatably accommodate vertical hammer mounting shaft 196. Hub portion 302 also preferably defines a plurality of, typically four, spring mounting protrusions 306.

Extending generally forwardly from hub portion 302 is a deflector mounting arm 308 from which extends a deflector 310. Deflector mounting arm 308 also preferably includes an attachment recess 312 and aperture 314 for optional mounting thereon of spray diffuser 212.

Extending generally rearwardly from hub portion 302 is a balancing arm 316.

Reference is now particularly made to deflector 310 and to FIGS. 3E-3K. It is a particular feature of the present invention that deflector 310 includes a first pressurized water stream engagement surface 320, which receives a water stream from the forward nozzle 190, and a second pressurized water stream engagement surface 322, downstream of the first pressurized water stream engagement surface 320, wherein the first pressurized water stream engagement surface 320 has a pressurized water stream channeling configuration arranged:

to direct a first portion of the pressurized water stream impinging on the first pressurized water stream engagement surface 320, which does not exceed a predetermined water stream quantity, onto the second pressurized water stream engagement surface 322, and to direct at least a second portion of the pressurized water stream impinging on the first pressurized water stream engagement surface 320, which second portion exceeds the predetermined water stream quantity, not onto the second pressurized water stream engagement surface 322.

Preferably, the second pressurized water stream engagement surface 322 has at least one, and typically two, water stream bypass apertures 324 formed therein and the first pressurized water stream engagement surface 320 is arranged to direct at least a second portion of the pressurized water stream impinging on the first pressurized water stream engagement surface 320 through the water stream bypass aperture or apertures 324.

It is also a particular feature of the present invention that the first pressurized water stream engagement surface 320 is preferably formed with two mutually spaced generally parallel upstanding vanes 330, having parallel mutually facing surfaces and non parallel opposite surfaces, which divide surface 320 into preferably three water engagement sub-surfaces 332, 334 and 336. In the illustrated embodiment, the width of each of water engagement sub-surfaces 332, 334 and 336 is generally identical, however, alternatively, the individual sub-surfaces 332, 334 and 336 may have different widths. Alternatively, the number of vanes 330 provided may be more or less than two.

Preferably vanes 330 have a generally truncated triangular cross section and have increased thickness from a stream incoming edge 340 of first pressurized water stream engagement surface 320 to a stream exiting edge 342 of the first pressurized water stream engagement surface 320. Preferably vanes 330 each have a tapered stream facing edge 344.

First water stream engagement surface 320 is preferably generally flat except for a short tapered portion adjacent incoming edge 340.

Both the first and second water stream engagement surfaces 320 and 322 are defined by side walls 350 and 352, which join first and second water stream engagement surfaces 320 and 322 and define an open space therebetween.

It is a further particular feature of the present invention that the second pressurized water stream engagement surface 322 is preferably formed with two mutually spaced generally parallel upstanding vanes 360 which divide surface 322 into preferably three water engagement sub-surfaces 362, 364 and 366.

In the illustrated embodiment, the width of each of water engagement sub-surfaces 362, 364 and 366 is generally identical, however, alternatively, the individual sub-surfaces 362, 364 and 366 may have different widths. Alternatively, the number of vanes 360 provided may be more or less than two.

Preferably vanes 360 have a generally uniform thickness from a stream incoming edge 370 of second pressurized water stream engagement surface 322 to a stream exiting edge 372 of the second pressurized water stream engagement surface 322. Preferably vanes 360 each have a tapered stream facing edge 374.

Second water stream engagement surface 322 is preferably generally curved, faces generally oppositely to first water stream engagement surface 320 and includes a generally flat portion 376 adjacent incoming edge 370, which extends into a generally curved portion 378, adjacent stream exiting edge 372.

It is an additional particular feature of the present invention that preferably water engagement sub-surfaces 362 and 366, on opposite sides of water engagement sub-surface 364, are formed with apertures extending nearly all along generally curved portion 378 and preferably along a downstream part of flat portion 376.

Figure 4A:
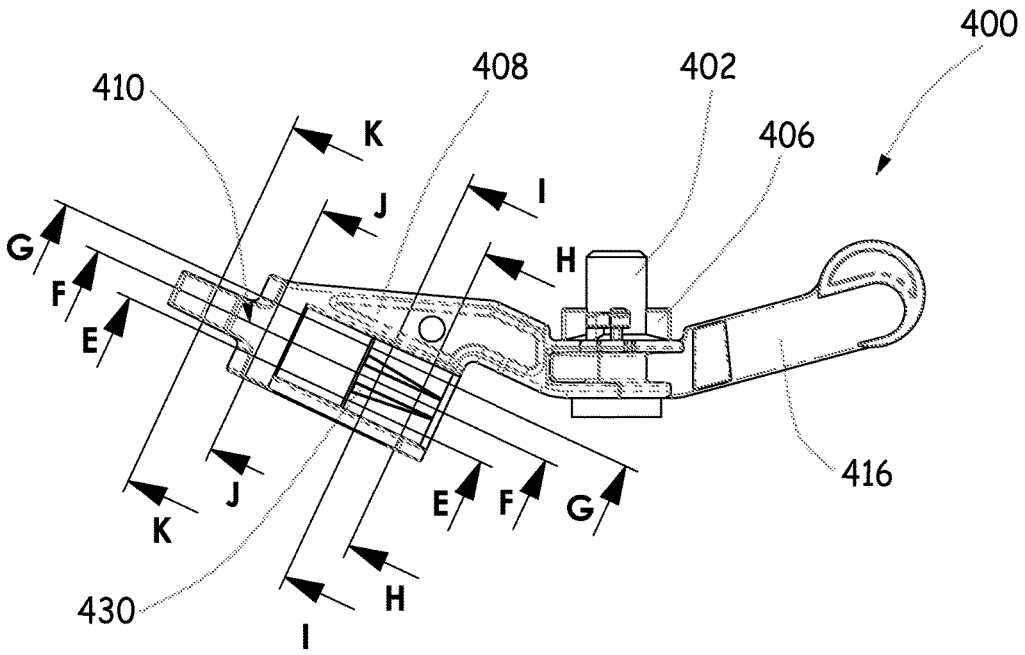
FIGS. 4A and 4B are simplified side view illustrations of an alternative hammer element suitable for forming part of the sprinkler of FIGS. 1A-1D, 2A & 2B, FIGS. 4A & 4B being mutually rotated by 180 degrees.
Figure 4B:
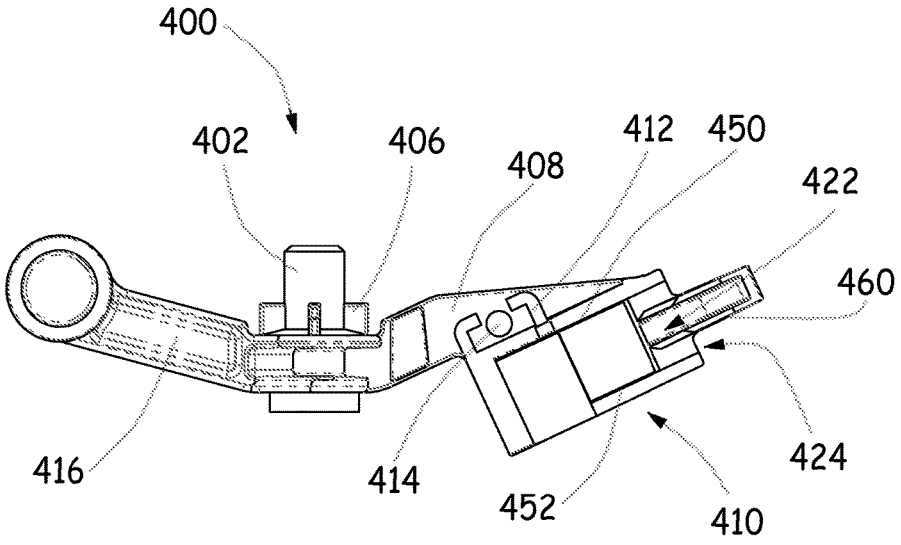
Figure 4C:
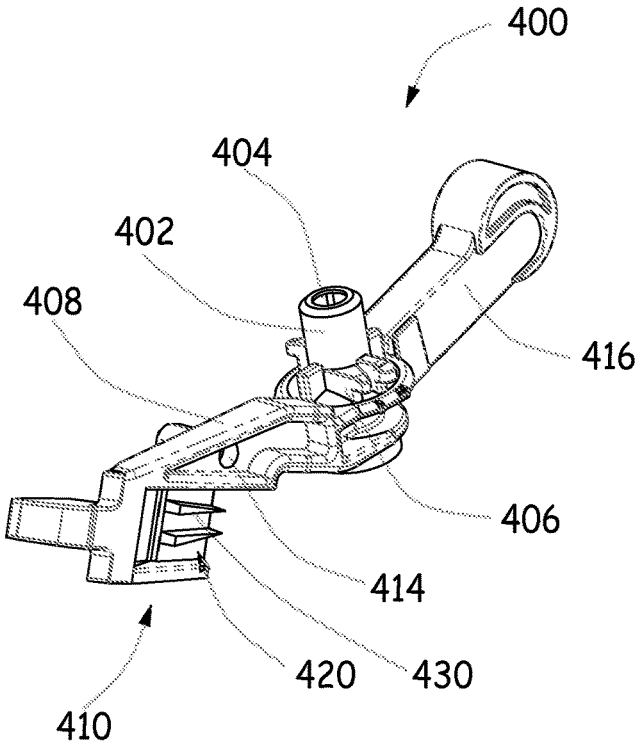
FIGS. 4C and 4D are simplified isometric illustrations of the hammer element of FIGS. 4A and 4B, taken from two different viewpoints.
Figure 4D:
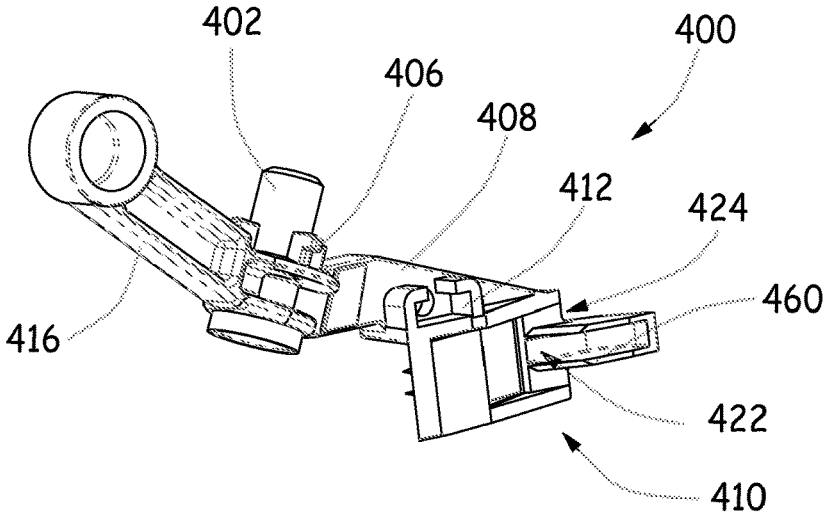
Figure 4E:
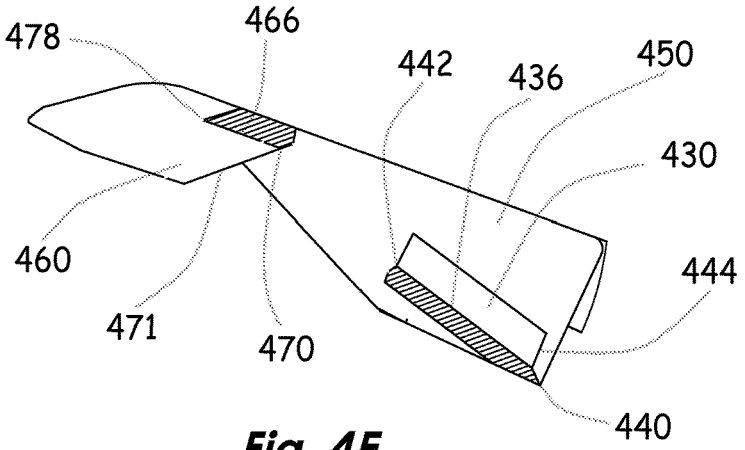
FIGS. 4E, 4F and 4G are simplified sectional illustrations taken along respective section lines E-E, F-F and G-G in FIG. 4A.
Figure 4F:
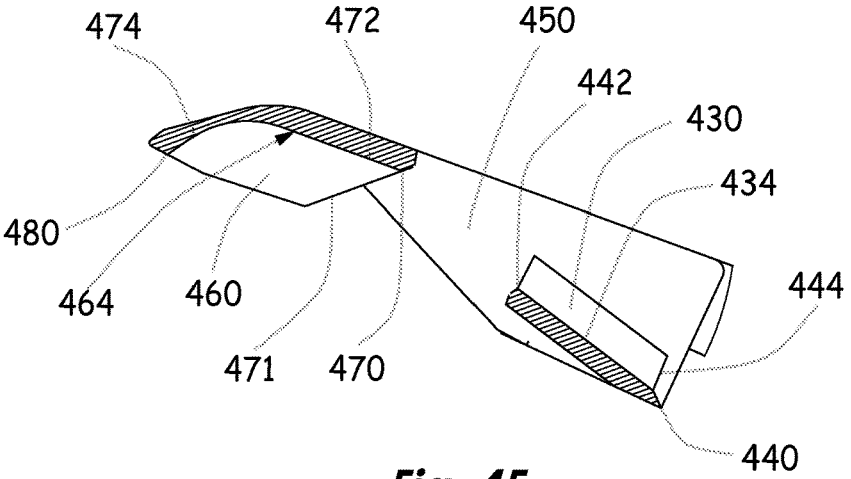
Figure 4G:
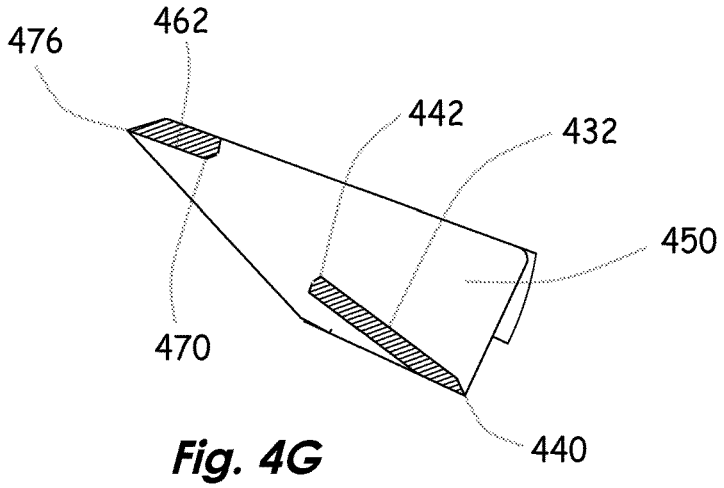
Figure 4H:
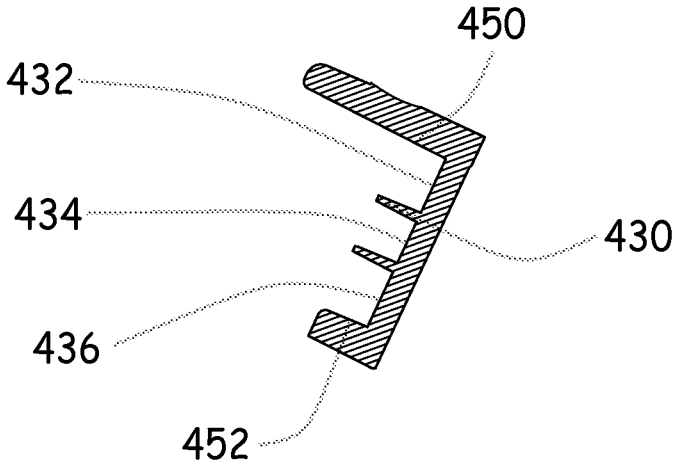
FIGS. 4H, 4I, 4J and 4K are simplified sectional illustrations taken along respective section lines H-H, I-I, J-J and K-K in FIG. 4A.
Figure 4I:
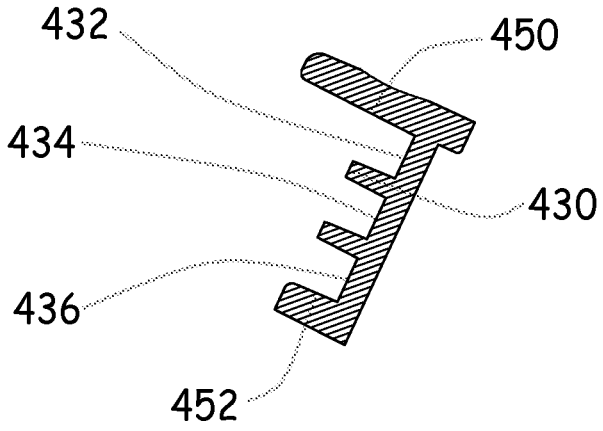
Figure 4J:
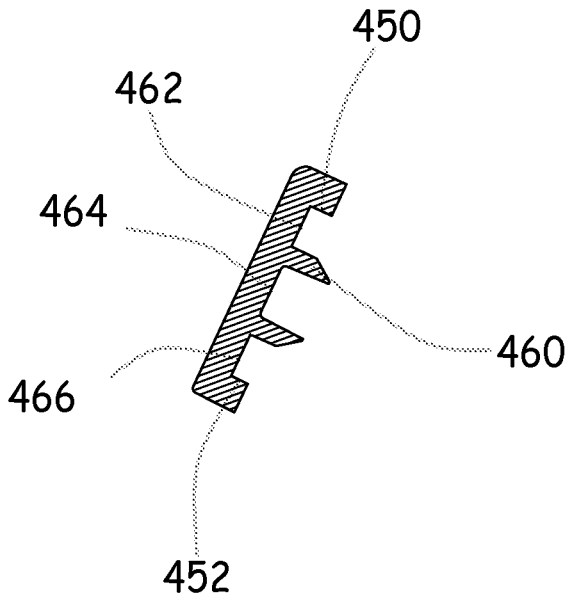
Figure 4K:
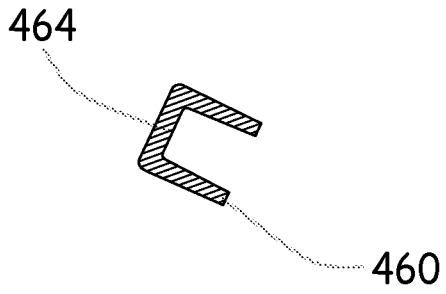

Reference is now made to FIGS. 4A and 4B, which are simplified side view illustrations of a hammer element 400 forming part of the sprinkler of FIGS. 1A-2B, FIGS. 4A & 4B being mutually rotated by 180 degrees, and to FIGS. 4C and 4D, which are simplified isometric illustrations of the hammer element of FIGS. 4A and 4B, taken from two different viewpoints. Reference is also made to FIGS. 4E, 4F and 4G, which are simplified sectional illustrations taken along respective section lines E-E, F-F and G-G in FIG. 4A, and to FIGS. 4H, 4I, 4J and 4K, which are simplified sectional illustrations taken along respective section lines H-H, I-I, J-J and K-K in FIG. 4A.

As seen in FIGS. 4A-4K, hammer 400 preferably includes a generally central hub portion 402 that defines a cylindrical sleeve portion 404 which is preferably sized to rotatably accommodate vertical hammer mounting shaft 196. Hub portion 402 also preferably defines a plurality of, typically four, spring mounting protrusions 406.

Extending generally forwardly from hub portion 402 is a deflector mounting arm 408 from which extends a deflector 410. Deflector mounting arm 408 also preferably includes an attachment recess 412 and aperture 414 for optional mounting thereon of spray diffuser 212.

Extending generally rearwardly from hub portion 402 is a balancing arm 416.

Reference is now particularly made to deflector 410 and to FIGS. 4E-4K. It is a particular feature of the present invention that deflector 410 includes a first pressurized water stream engagement surface 420, which receives a water stream from the forward nozzle 190, and a second pressurized water stream engagement surface 422, downstream of the first pressurized water stream engagement surface 420, wherein the first pressurized water stream engagement surface 420 has a pressurized water stream channeling configuration arranged:

- to direct a first portion of the pressurized water stream impinging on the first pressurized water stream 420, which does not exceed a predetermined water stream quantity, onto the second pressurized water stream engagement surface 422, and
- to direct at least a second portion of the pressurized water stream impinging on the first pressurized water stream engagement surface 420, which second portion exceeds the predetermined water stream quantity, not onto the second pressurized water stream engagement surface 422.

Preferably, the second pressurized water stream engagement surface 422 has at least one, and typically two, water stream bypass apertures 424 formed therein and the first pressurized water stream engagement surface 420 is arranged to direct at least a second portion of the pressurized water stream impinging on the first pressurized water stream engagement surface 420 through the water stream bypass aperture or apertures 424.

It is also a particular feature of the present invention that the first pressurized water stream engagement surface 420 is preferably formed with two mutually spaced generally parallel upstanding vanes 430, having parallel mutually facing surfaces and non parallel opposite surfaces, which divide surface 420 into preferably three water engagement sub-surfaces 432, 434 and 436. In the illustrated embodiment, the width of each of water engagement sub-surfaces 432, 434 and 436 is generally identical, however, alternatively, the individual sub-surfaces 432, 434 and 436 may have different widths. Alternatively, the number of vanes 430 provided may be more or less than two.

Preferably vanes 430 have a generally truncated triangular cross section and have increased thickness from a stream incoming edge 440 of first pressurized water stream engagement surface 420 to a stream exiting edge 442 of the first pressurized water stream engagement surface 420. Preferably vanes 430 each have a tapered stream facing edge 444.

First water stream engagement surface 420 is preferably generally flat except for a short tapered portion adjacent incoming edge 440.

Both the first and second water stream engagement surfaces 420 and 422 are defined by side walls 450 and 452, which join first and second water stream engagement surfaces 420 and 422 and define an open space therebetween.

It is a further particular feature of the present invention that the second pressurized water stream engagement surface 422 is preferably formed with two mutually spaced generally parallel upstanding vanes 460 which divide surface 422 into preferably three water engagement sub-surfaces 462, 464 and 466.

In the illustrated embodiment, the width of each of water engagement sub-surfaces 462, 464 and 466 is generally identical, however, alternatively, the individual sub-surfaces 462, 464 and 466 may have different widths. Alternatively, the number of vanes 460 provided may be more or less than two.

Preferably vanes 460 have a generally uniform thickness therealong from a stream incoming edge 470 of second pressurized water stream engagement surface 422. Preferably vanes 460 each have a tapered stream facing edge 471.

Second water stream engagement surface 422 is preferably generally curved, faces generally oppositely to first water stream engagement surface 420 and includes a generally flat portion 472 adjacent incoming edge 470. Only water engagement sub-surface 464 extends into a generally curved portion 474.

Thus it is appreciated that, as distinct from the embodiment described hereinabove with reference to FIGS. 3A-3K, in the embodiment of FIGS. 4A-4K, the water engagement sub-surfaces 462 and 466 have respective stream exiting edges 476 and 478, which are relatively close to and downstream of stream incoming edge 470 and water engagement sub-surface 464 has a stream exiting edge 480 which is much further downstream thereof.

Figure 5A:
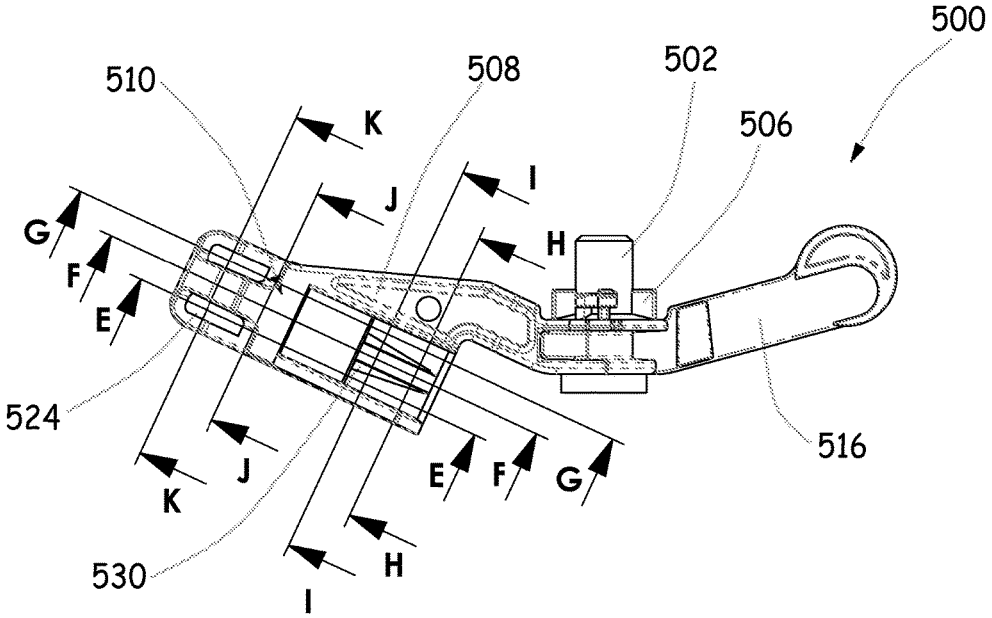
FIGS. 5A and 5B are simplified side view illustrations of a further alternative hammer element suitable for forming part of the sprinkler of FIGS. 1A-1D, 2A & 2B, FIGS. 5A & 5B being mutually rotated by 180 degrees.
Figure 5B:
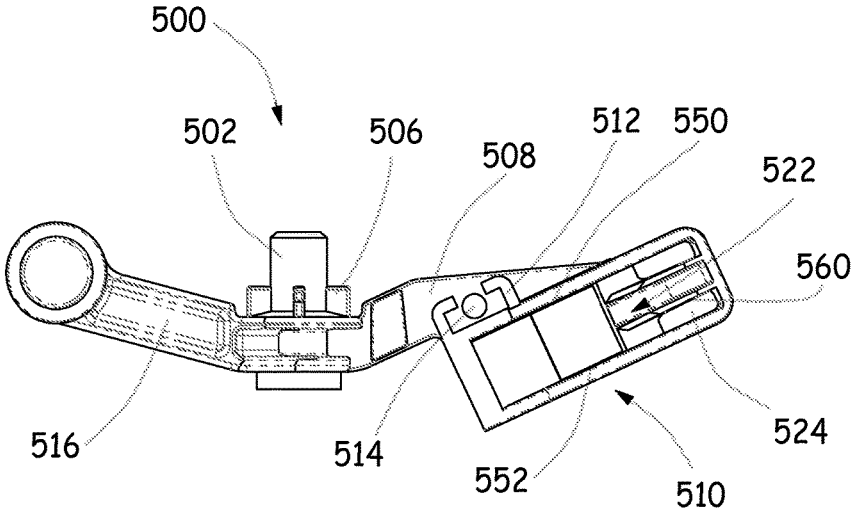
Figure 5C:
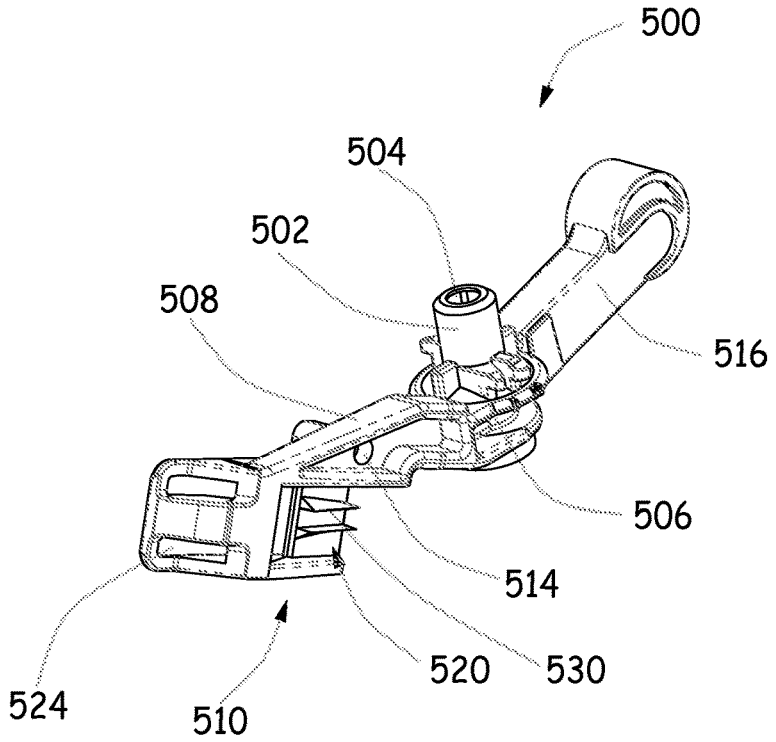
FIGS. 5C and 5D are simplified isometric illustrations of the hammer element of FIGS. 5A and 5B, taken from two different viewpoints.
Figure 5D:
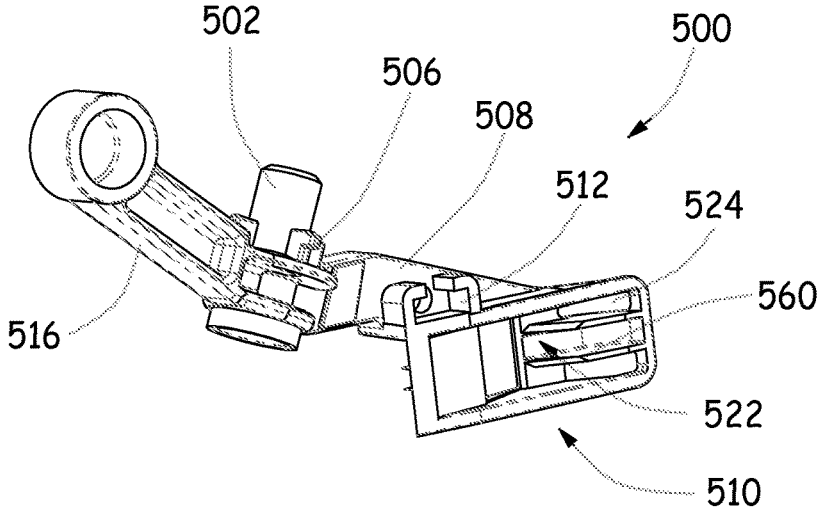
Figure 5E:
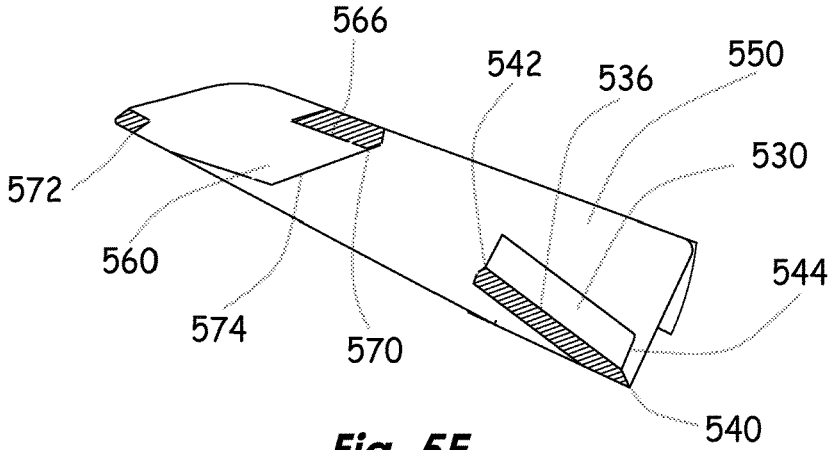
FIGS. 5E, 5F and 5G are simplified sectional illustrations taken along respective section lines E-E, F-F and G-G in FIG. 5A.
Figure 5F:
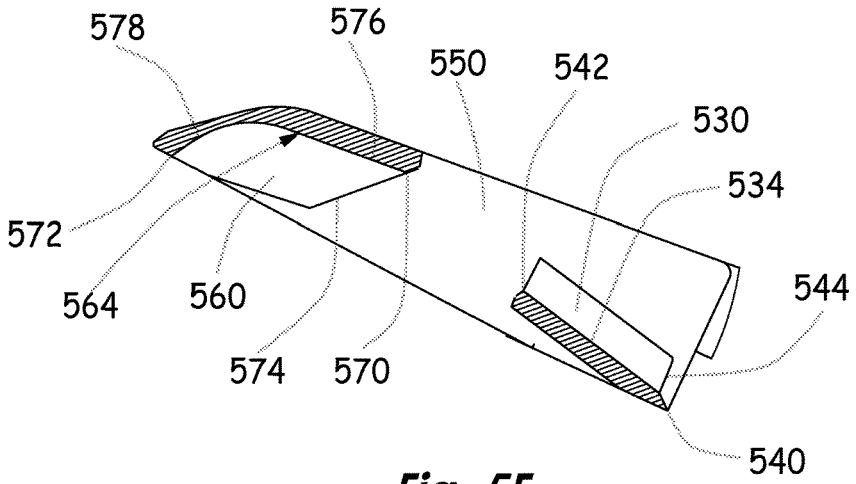
Figure 5G:
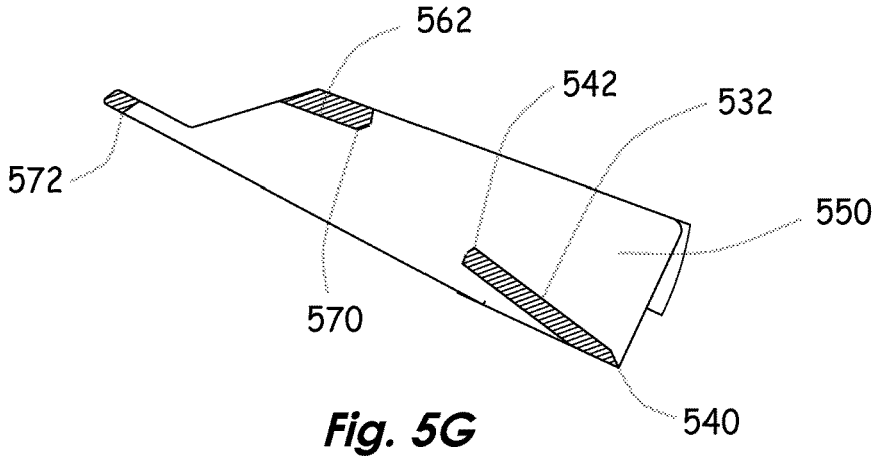
Figure 5H:
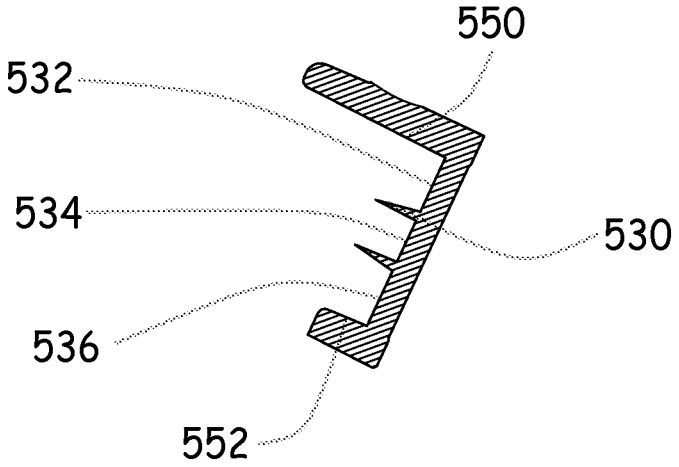
FIGS. 5H, 5I, 5J and 5K are simplified sectional illustrations taken along respective section lines H-H, I-I, J-J and K-K in FIG. 5A.
Figure 5I:
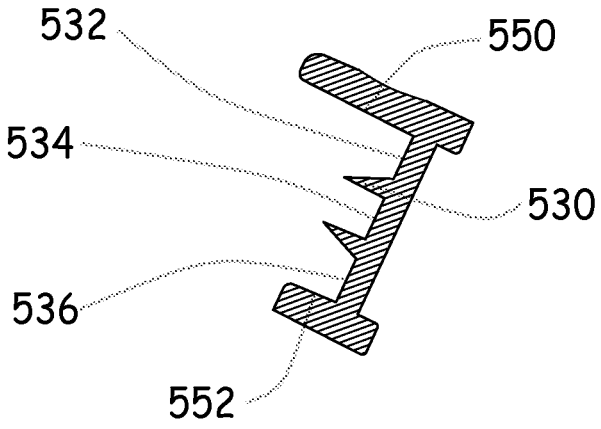
Figure 5J:
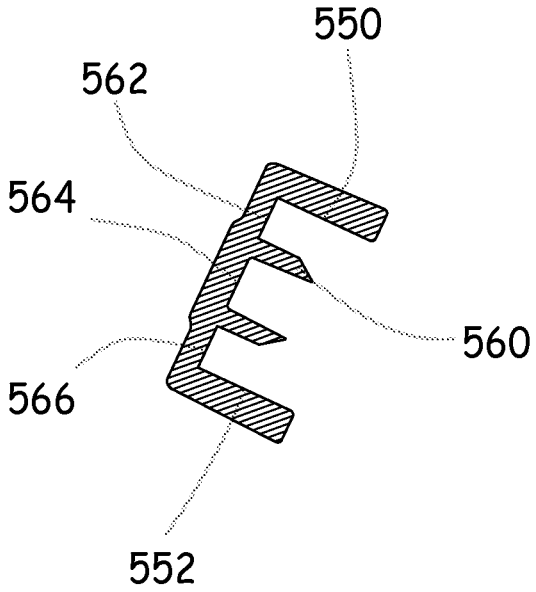
Figure 5K:
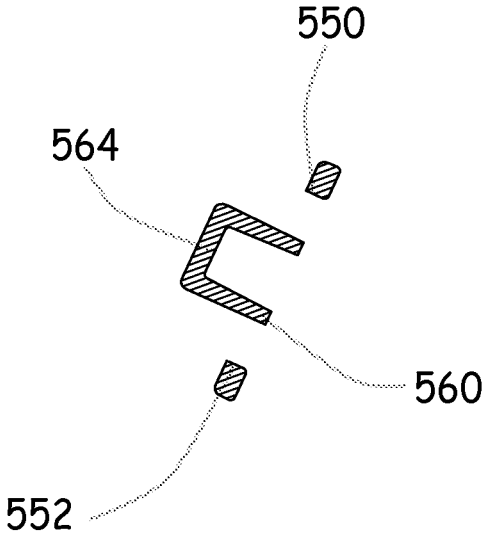

Reference is now made to FIGS. 5A and 5B, which are simplified side view illustrations of a hammer element 500 forming part of the sprinkler of FIGS. 1A-2B, FIGS. 5A & 5B being mutually rotated by 180 degrees, and to FIGS. 5C and 5D, which are simplified isometric illustrations of the hammer element of FIGS. 5A and 5B, taken from two different viewpoints. Reference is also made to FIGS. 5E, 5F and 5G, which are simplified sectional illustrations taken along respective section lines E-E, F-F and G-G in FIG. 5A, and to FIGS. 5H, 5I, 5J and 5K, which are simplified sectional illustrations taken along respective section lines H-H, I-I, J-J and K-K in FIG. 5A.

As seen in FIGS. 5A-5K, hammer 500 preferably includes a generally central hub portion 502 that defines a cylindrical sleeve portion 504 which is preferably sized to rotatably accommodate vertical hammer mounting shaft 196. Hub portion 502 also preferably defines a plurality of, typically four, spring mounting protrusions 506.

Extending generally forwardly from hub portion 502 is a deflector mounting arm 508 from which extends a deflector 510. Deflector mounting arm 508 also preferably includes an attachment recess 512 and aperture 514 for optional mounting thereon of spray diffuser 212.

Extending generally rearwardly from hub portion 502 is a balancing arm 516.

Reference is now particularly made to deflector 510 and to FIGS. 5E-5K. It is a particular feature of the present invention that deflector 510 includes a first pressurized water stream engagement surface 520, which receives a water stream from the forward nozzle 190, and a second pressurized water stream engagement surface 522, downstream of the first pressurized water stream engagement surface 520, wherein the first pressurized water stream engagement surface 520 has a pressurized water stream channeling configuration arranged:

- to direct a first portion of the pressurized water stream impinging on the first pressurized water stream engagement surface 520, which does not exceed a predetermined water stream quantity, onto the second pressurized water stream engagement surface 522, and
- to direct at least a second portion of the pressurized water stream impinging on the first pressurized water stream engagement surface 520, which second portion exceeds the predetermined water stream quantity, not onto the second pressurized water stream engagement surface 522.

Preferably, the second pressurized water stream engagement surface 522 has at least one, and typically two, water stream bypass apertures 524 formed therein and the first pressurized water stream engagement surface 520 is arranged to direct at least a second portion of the pressurized water stream impinging on the first pressurized water stream engagement surface 520 through the water stream bypass aperture or apertures 524.

It is also a particular feature of the present invention that the first pressurized water stream engagement surface 520 is preferably formed with two mutually spaced generally parallel upstanding vanes 530, having parallel mutually facing surfaces and non parallel opposite surfaces, which divide surface 520 into preferably three water engagement sub-surfaces 532, 534 and 536. In the illustrated embodiment, the width of each of water engagement sub-surfaces 532, 534 and 536 is generally identical, however, alternatively, the individual sub-surfaces 532, 534 and 536 may have different widths. Alternatively, the number of vanes 530 provided may be more or less than two.

Preferably vanes 530 have a generally triangular cross section and have increased thickness from a stream incoming edge 540 of first pressurized water stream engagement surface 520 to a stream exiting edge 542 of the first pressurized water stream engagement surface 520. Preferably vanes 530 each have a tapered stream facing edge 544.

First water stream engagement surface 520 is preferably generally flat except for a short tapered portion adjacent incoming edge 540.

Both the first and second water stream engagement surfaces 520 and 522 are defined by side walls 550 and 552, which join first and second water stream engagement surfaces 520 and 522 and define an open space therebetween.

It is a further particular feature of the present invention that the second pressurized water stream engagement surface 522 is preferably formed with two mutually spaced generally parallel upstanding vanes 560 which divide surface 522 into preferably three water engagement sub-surfaces 562, 564 and 566.

In the illustrated embodiment, the width of each of water engagement sub-surfaces 562, 564 and 566 is generally identical, however, alternatively, the individual sub-surfaces 562, 564 and 566 may have different widths. Alternatively, the number of vanes 560 provided may be more or less than two.

Preferably vanes 560 have a generally uniform thickness from a stream incoming edge 570 of second pressurized water stream engagement surface 522 to a stream exiting edge 572 of the second pressurized water stream engagement surface 522. Preferably vanes 560 each have a tapered stream facing edge 574.

Second water stream engagement surface 522 is preferably generally curved, faces generally oppositely to first water stream engagement surface 520 and includes a generally flat portion 576 adjacent incoming edge 570, which extends into a generally curved portion 578, adjacent stream exiting edge 572.

It is an additional particular feature of the present invention that preferably water engagement sub-surfaces 562 and 566, on opposite sides of water engagement sub-surface 564, are formed with apertures extending nearly all along generally curved portion 578 and preferably along a downstream part of flat portion 576.

Figure 6A:
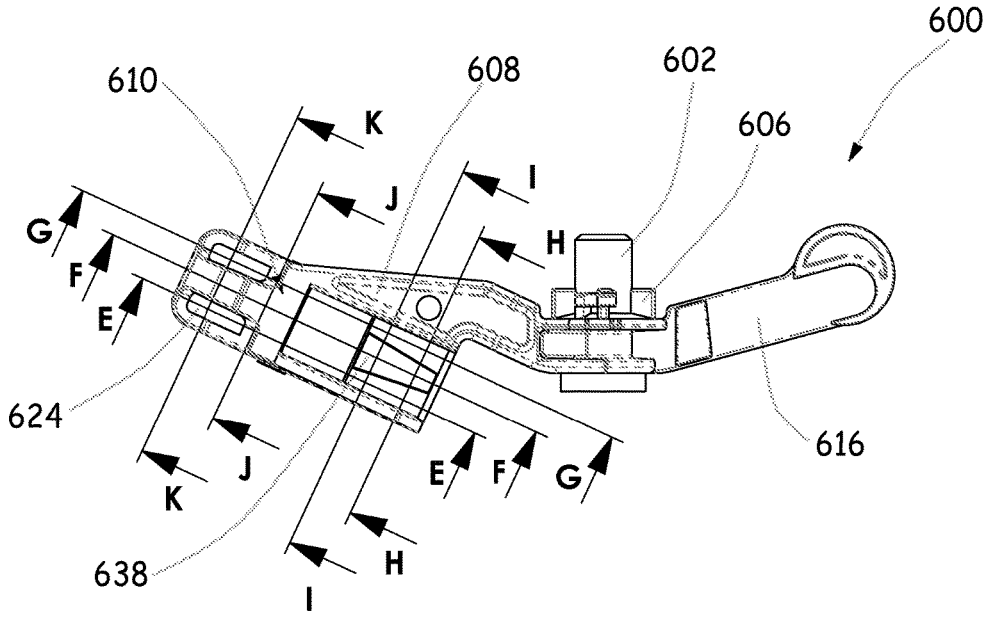
FIGS. 6A and 6B are simplified side view illustrations of another hammer element suitable for forming part of the sprinkler of FIGS. 1A-1D, 2A & 2B, FIGS. 6A & 6B being mutually rotated by 180 degrees.
Figure 6B:
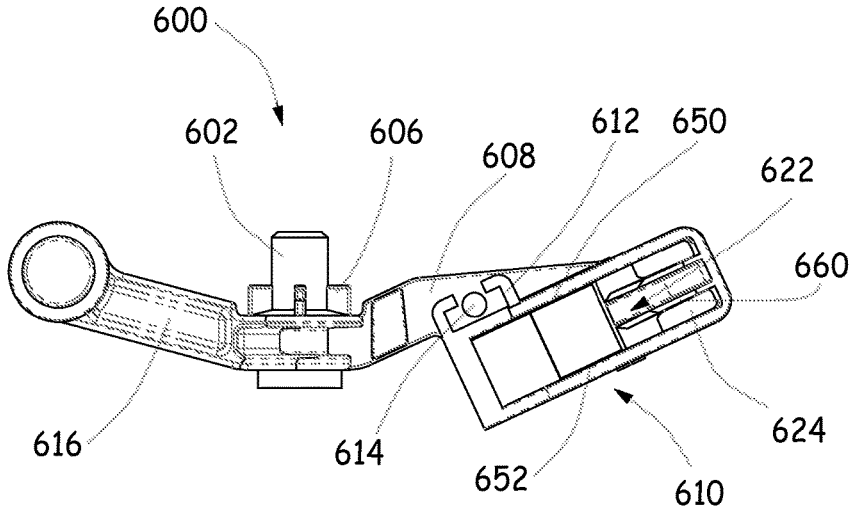
Figure 6C:
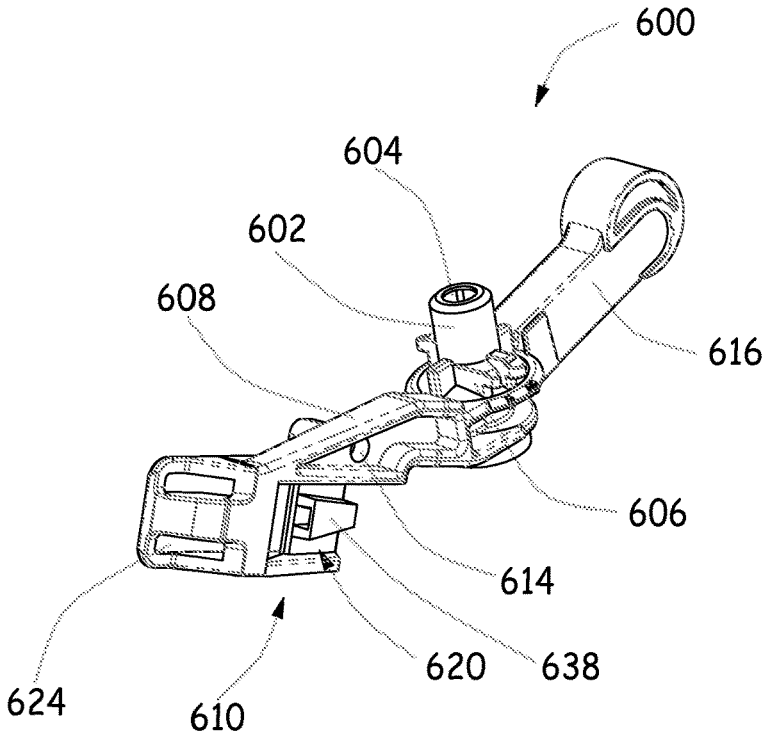
FIGS. 6C and 6D are simplified isometric illustrations of the hammer element of FIGS. 6A and 6B, taken from two different viewpoints.
Figure 6D:
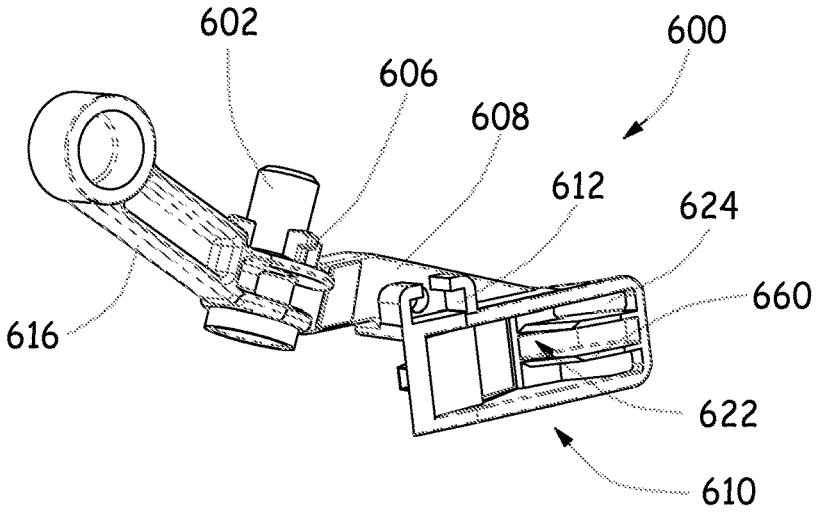
Figure 6E:
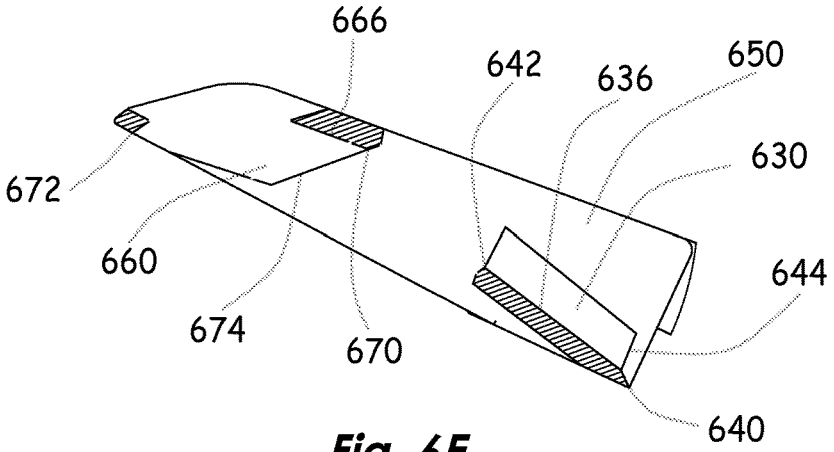
FIGS. 6E, 6F and 6G are simplified sectional illustrations taken along respective section lines E-E, F-F and G-G in FIG. 6A.
Figure 6F:
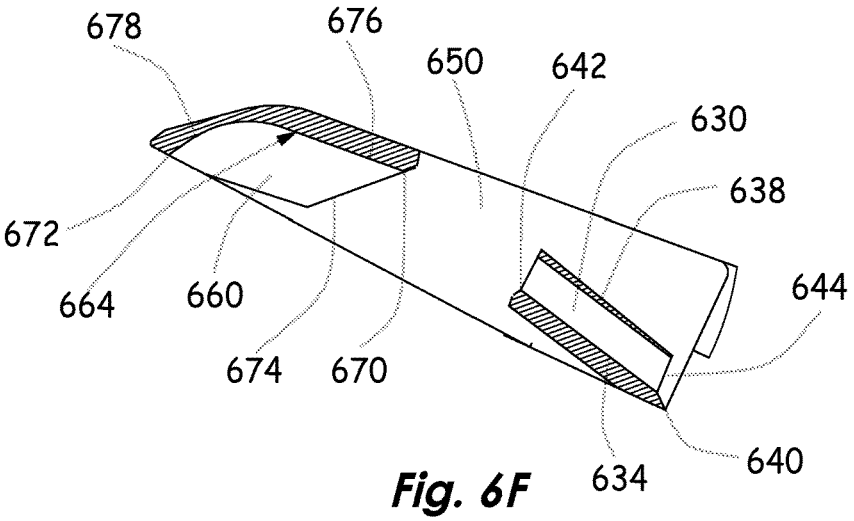
Figure 6G:
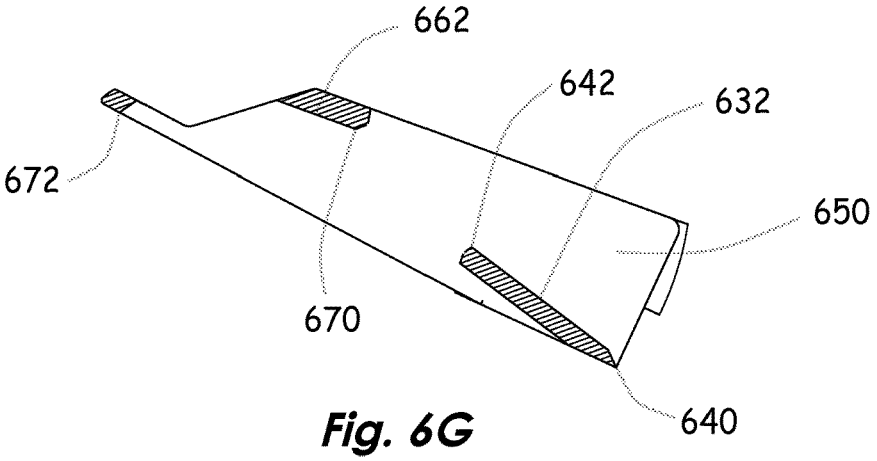
Figure 6H:
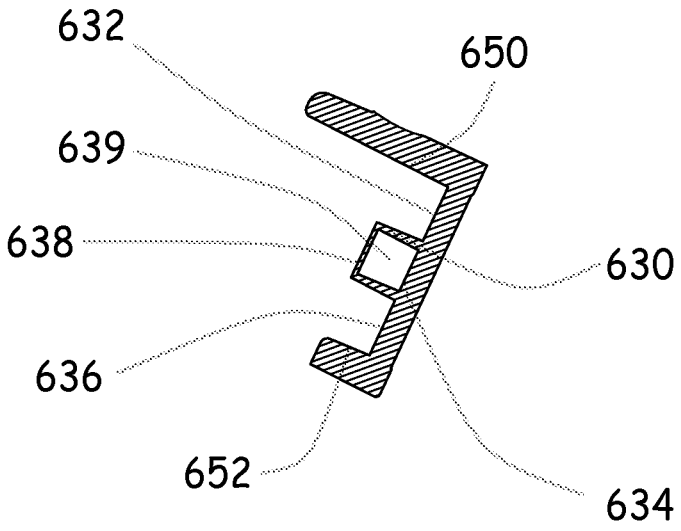
FIGS. 6H, 6I, 6J and 6K are simplified sectional illustrations taken along respective section lines H-H, I-I, J-J and K-K in FIG. 6A.
Figure 6I:
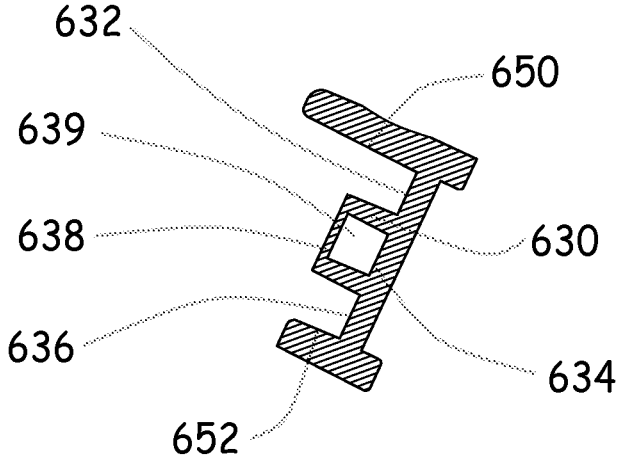
Figure 6J:
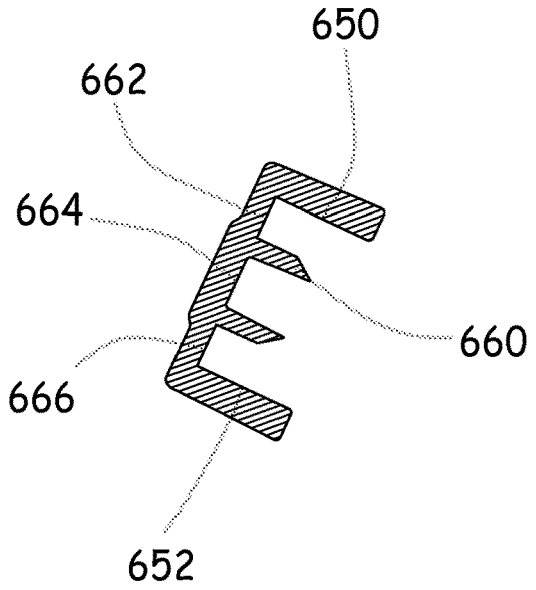
Figure 6K:
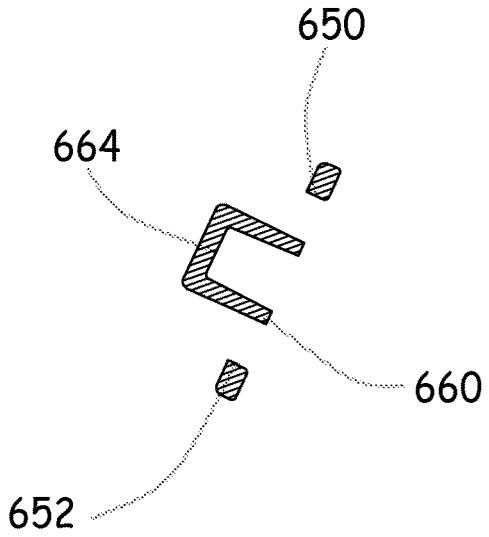

Reference is now made to FIGS. 6A and 6B, which are simplified side view illustrations of a hammer element 600 forming part of the sprinkler of FIGS. 1A-2B, FIGS. 6A & 6B being mutually rotated by 180 degrees, and to FIGS. 6C and 6D, which are simplified isometric illustrations of the hammer element of FIGS. 6A and 6B, taken from two different viewpoints. Reference is also made to FIGS. 6E, 6F and 6G, which are simplified sectional illustrations taken along respective section lines E-E, F-F and G-G in FIG. 6A, and to FIGS. 6H, 6I, 6J and 6K, which are simplified sectional illustrations taken along respective section lines H-H, I-I, J-J and K-K in FIG. 6A.

As seen in FIGS. 6A-6K, hammer 600 preferably includes a generally central hub portion 602 that defines a cylindrical sleeve portion 604 which is preferably sized to rotatably accommodate vertical hammer mounting shaft 196. Hub portion 602 also preferably defines a plurality of, typically four, spring mounting protrusions 606.

Extending generally forwardly from hub portion 602 is a deflector mounting arm 608 from which extends a deflector 610. Deflector mounting arm 608 also preferably includes an attachment recess 612 and aperture 614 for optional mounting thereon of spray diffuser 212.

Extending generally rearwardly from hub portion 602 is a balancing arm 616.

Reference is now particularly made to deflector 610 and to FIGS. 6E-6K. It is a particular feature of the present invention that deflector 610 includes a first pressurized water stream engagement surface 620, which receives a water stream from the forward nozzle 190, and a second pressurized water stream engagement surface 622, downstream of the first pressurized water stream engagement surface 620, wherein the first pressurized water stream engagement surface 620 has a pressurized water stream channeling configuration arranged:

to direct a first portion of the pressurized water stream impinging on the first pressurized water stream engagement surface 620, which does not exceed a predetermined water stream quantity, onto the second pressurized water stream engagement surface 622, and to direct at least a second portion of the pressurized water stream impinging on the first pressurized water stream engagement surface 620, which second portion exceeds the predetermined water stream quantity, not onto the second pressurized water stream engagement surface 622.

Preferably, the second pressurized water stream engagement surface 622 has at least one, and typically two, water stream bypass apertures 624 formed therein and the first pressurized water stream engagement surface 620 is arranged to direct at least a second portion of the pressurized water stream impinging on the first pressurized water stream engagement surface 620 through the water stream bypass aperture or apertures 624.

It is also a particular feature of the present invention that the first pressurized water stream engagement surface 620 is preferably formed with two mutually spaced generally parallel upstanding vanes 630, having parallel mutually facing surfaces and non parallel opposite surfaces, which divide surface 620 into preferably three water engagement sub-surfaces 632, 634 and 636. In the illustrated embodiment, the width of each of water engagement sub-surfaces 632, 634 and 636 is generally identical, however, alternatively, the individual sub-surfaces 632, 634 and 636 may have different widths. Alternatively, the number of vanes 630 provided may be more or less than two. In this embodiment, vanes 630 are joined by an integrally formed top plate 638, thereby defining a water flow channel 639 between vanes 630 and top plate 638.

Preferably vanes 630 have a generally truncated triangular cross section and have increased thickness from a stream incoming edge 640 of first pressurized water stream engagement surface 620 to a stream exiting edge 642 of the first pressurized water stream engagement surface 620. Preferably vanes 630 each have a tapered stream facing edge 644.

First water stream engagement surface 620 is preferably generally flat except for a short tapered portion adjacent incoming edge 640.

Both the first and second water stream engagement surfaces 620 and 622 are defined by side walls 650 and 652, which join first and second water stream engagement surfaces 620 and 622 and define an open space therebetween.

It is a further particular feature of the present invention that the second pressurized water stream engagement surface 622 is preferably formed with two mutually spaced generally parallel upstanding vanes 660 which divide surface 622 into preferably three water engagement sub-surfaces 662, 664 and 666.

In the illustrated embodiment, the width of each of water engagement sub-surfaces 662, 664 and 666 is generally identical, however, alternatively, the individual sub-surfaces 662, 664 and 666 may have different widths. Alternatively, the number of vanes 660 provided may be more or less than two.

Preferably vanes 660 have a generally uniform thickness from a stream incoming edge 670 of second pressurized water stream engagement surface 622 to a stream exiting edge 672 of the second pressurized water stream engagement surface 622. Preferably vanes 660 each have a tapered stream facing edge 674.

Second water stream engagement surface 622 is preferably generally curved, faces generally oppositely to first water stream engagement surface 620 and includes a generally flat portion 676 adjacent incoming edge 670, which extend into a generally curved portion 678, adjacent stream exiting edge 672.

It is an additional particular feature of the present invention that preferably water engagement sub-surfaces 662 and 666, on opposite sides of water engagement sub-surface 664, are formed with apertures extending nearly all along generally curved portion 678 and preferably along a downstream part of flat portion 676.

Figure 7A:
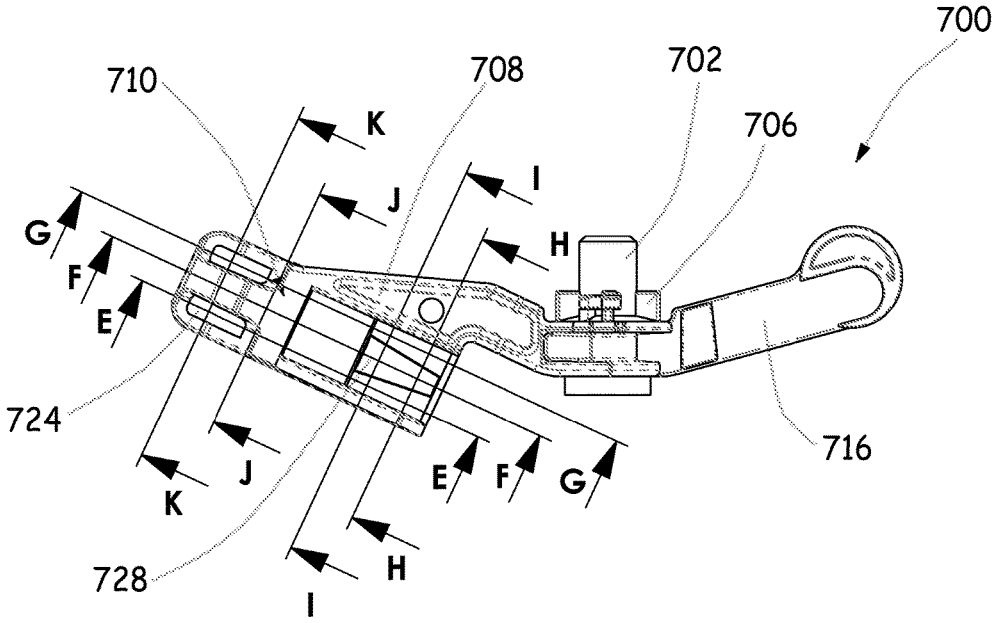
FIGS. 7A and 7B are simplified side view illustrations of yet another hammer element suitable for forming part of the sprinkler of FIGS. 1A-1D, 2A & 2B, FIGS. 7A & 7B being mutually rotated by 180 degrees.
Figure 7B:
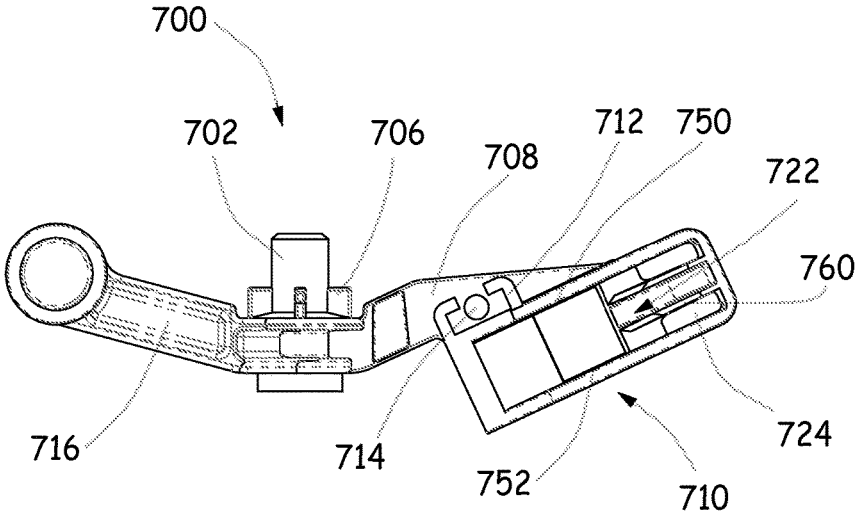
Figure 7C:
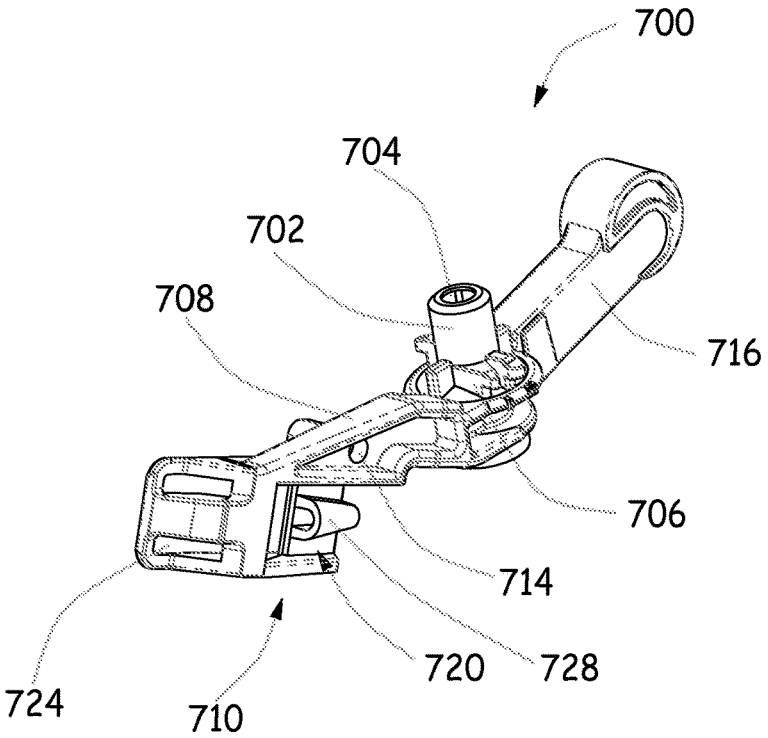
FIGS. 7C and 7D are simplified isometric illustrations of the hammer element of FIGS. 7A and 7B, taken from two different viewpoints.
Figure 7D:
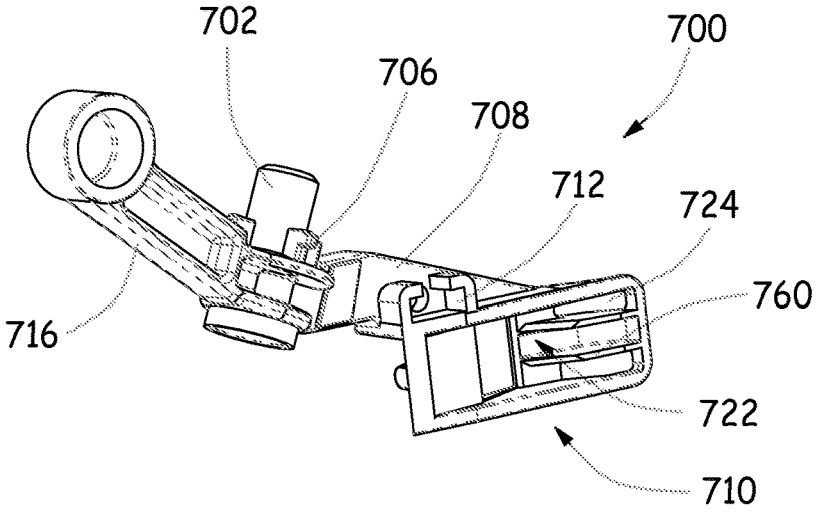
Figure 7E:
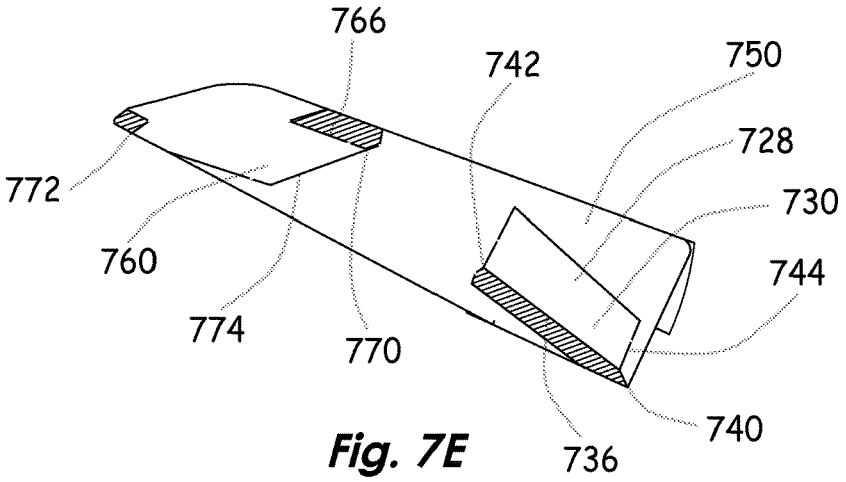
FIGS. 7E, 7F and 7G are simplified sectional illustrations taken along respective section lines E-E, F-F and G-G in FIG. 7A.
Figure 7F:
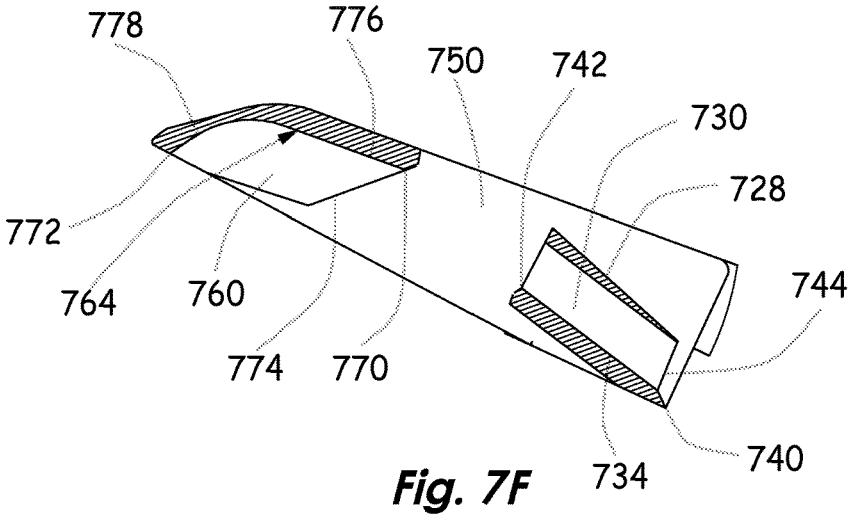
Figure 7G:
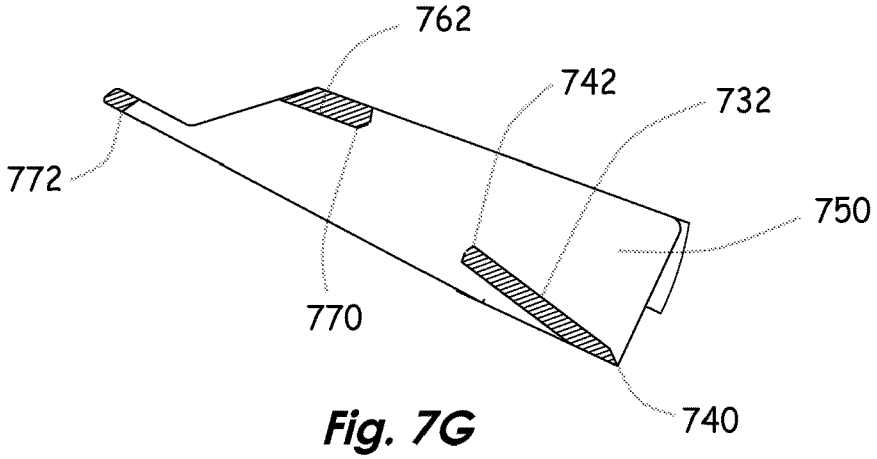
Figure 7H:
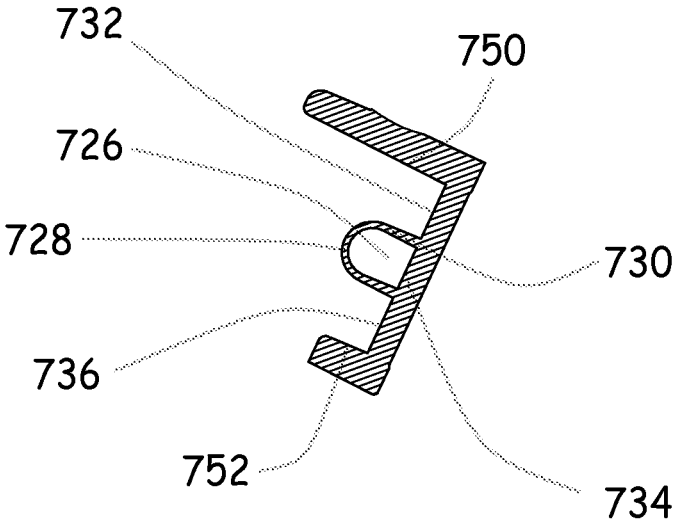
FIGS. 7H, 7I, 7J and 7K are simplified sectional illustrations taken along respective section lines H-H, I-I, J-J and K-K in FIG. 7A.
Figure 7I:
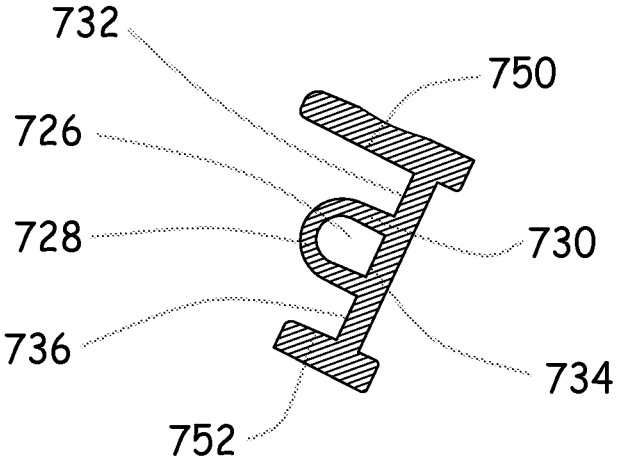
Figure 7J:
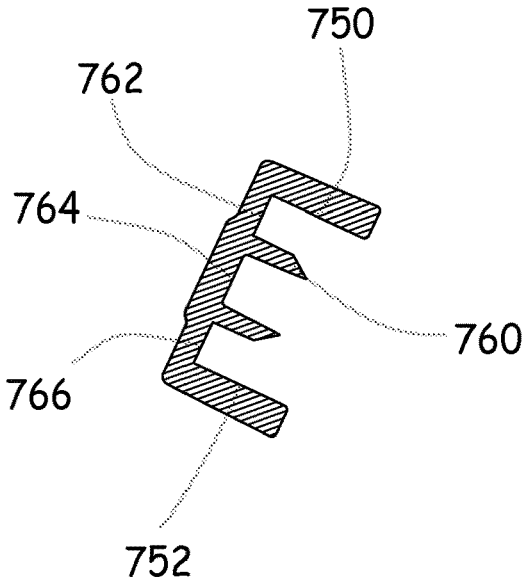
Figure 7K:
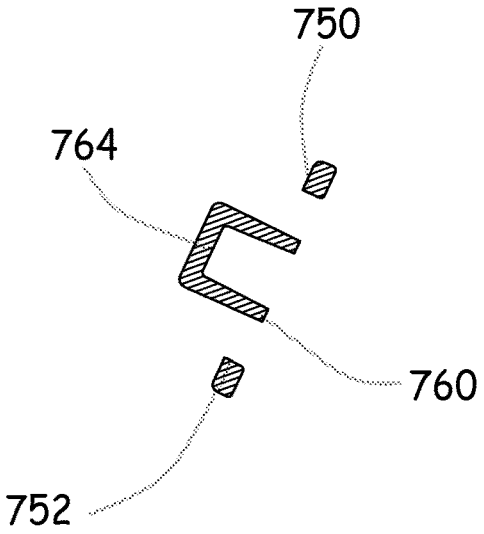

Reference is now made to FIGS. 7A and 7B, which are simplified side view illustrations of a hammer element 700 forming part of the sprinkler of FIGS. 1A-2B, FIGS. 7A & 7B being mutually rotated by 180 degrees, and to FIGS. 7C and 7D, which are simplified isometric illustrations of the hammer element of FIGS. 7A and 7B, taken from two different viewpoints. Reference is also made to FIGS. 7E, 7F and 7G, which are simplified sectional illustrations taken along respective section lines E-E, F-F and G-G in FIG. 7A, and to FIGS. 7H, 7I, 7J and 7K, which are simplified sectional illustrations taken along respective section lines H-H, I-I, J-J and K-K in FIG. 7A.

As seen in FIGS. 7A-7K, hammer 700 preferably includes a generally central hub portion 702 that defines a cylindrical sleeve portion 704 which is preferably sized to rotatably accommodate vertical hammer mounting shaft 196. Hub portion 702 also preferably defines a plurality of, typically four, spring mounting protrusions 706.

Extending generally forwardly from hub portion 702 is a deflector mounting arm 708 from which extends a deflector 710. Deflector mounting arm 708 also preferably includes an attachment recess 712 and aperture 714 for optional mounting thereon of spray diffuser 212.

Extending generally rearwardly from hub portion 702 is a balancing arm 716.

Reference is now particularly made to deflector 710 and to FIGS. 7E-7K. It is a particular feature of the present invention that deflector 710 includes a first pressurized water stream engagement surface 720, which receives a water stream from the forward nozzle 190, and a second pressurized water stream engagement surface 722, downstream of the first pressurized water stream engagement surface 720, wherein the first pressurized water stream engagement surface 720 has a pressurized water stream channeling configuration arranged:

to direct a first portion of the pressurized water stream impinging on the first pressurized water stream engagement surface 720, which does not exceed a predetermined water stream quantity, onto the second pressurized water stream engagement surface 722, and to direct at least a second portion of the pressurized water stream impinging on the first pressurized water stream engagement surface 720, which second portion exceeds the predetermined water stream quantity, not onto the second pressurized water stream engagement surface 722.

Preferably, the second pressurized water stream engagement surface 722 has at least one, and typically two, water stream bypass apertures 724 formed therein and the first pressurized water stream engagement surface 720 is arranged to direct at least a second portion of the pressurized water stream impinging on the first pressurized water stream engagement surface 720 through the water stream bypass aperture or apertures 724.

It is also a particular feature of the present invention that the first pressurized water stream engagement surface 720 is preferably formed with a central, generally arched water flow channel 726 defined by an elongate arch 728 joining two, mutually spaced generally parallel upstanding vanes 730, which divide surface 720 into preferably three water engagement sub-surfaces 732, 734 and 736. In the illustrated embodiment, the width of each of water engagement sub-surfaces 732, 734 and 736 is generally identical, however, alternatively, the individual sub-surfaces 732, 734 and 736 may have different widths. Alternatively, the number of vanes 730 provided may be more or less than two.

Preferably vanes 730 have increased thickness from a stream incoming edge 740 of first pressurized water stream engagement surface 720 to a stream exiting edge 742 of the first pressurized water stream engagement surface 720. Preferably vanes 730 each have a tapered stream facing edge 744.

First water stream engagement surface 720 is preferably generally flat except for a short tapered portion adjacent incoming edge 740.

Both the first and second water stream engagement surfaces 720 and 722 are defined by side walls 750 and 752, which join first and second water stream engagement surfaces 720 and 722 and define an open space therebetween.

It is a further particular feature of the present invention that the second pressurized water stream engagement surface 722 is preferably formed with two mutually spaced generally parallel upstanding vanes 760 which divide surface 722 into preferably three water engagement sub-surfaces 762, 764 and 766.

In the illustrated embodiment, the width of each of water engagement sub-surfaces 762, 764 and 766 is generally identical, however, alternatively, the individual sub-surfaces 762, 764 and 766 may have different widths. Alternatively, the number of vanes 760 provided may be more or less than two.

Preferably vanes 760 have a generally uniform thickness from a stream incoming edge 770 of second pressurized water stream engagement surface 722 to a stream exiting edge 772 of the second pressurized water stream engagement surface 722. Preferably vanes 760 each have a tapered stream facing edge 774.

Second water stream engagement surface 722 is preferably generally curved, faces generally oppositely to first water stream engagement surface 720 and includes a generally flat portion 776 adjacent incoming edge 770, which extends into a generally curved portion 778, adjacent stream exiting edge 772.

It is an additional particular feature of the present invention that preferably water engagement sub-surfaces 762 and 766, on opposite sides of water engagement sub-surface 764, are formed with apertures extending nearly all along generally curved portion 778 and preferably along a downstream part of flat portion 776.

Figure 8A:
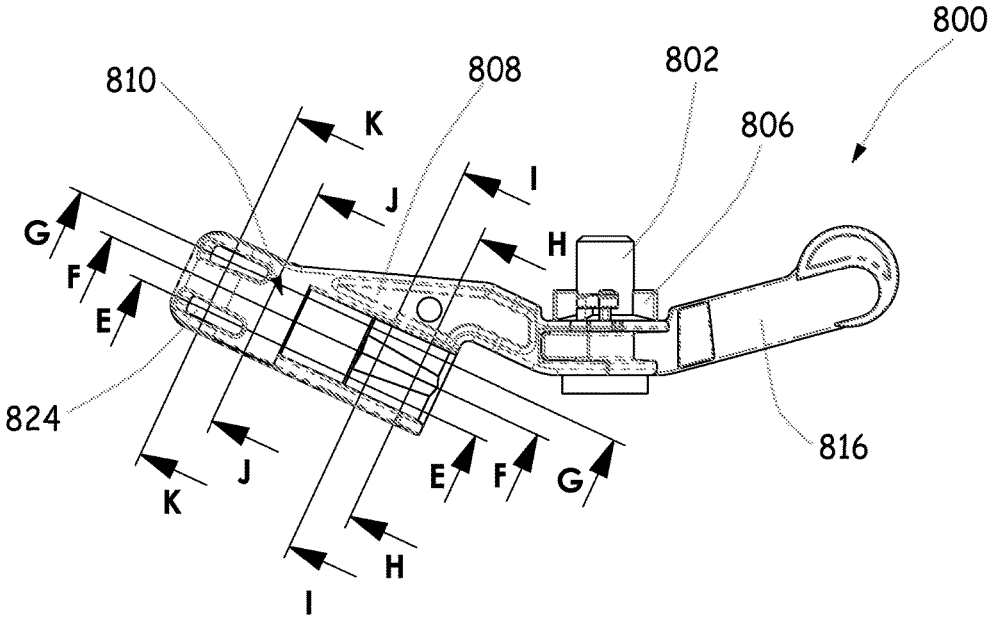
FIGS. 8A and 8B are simplified side view illustrations of still another hammer element suitable for forming part of the sprinkler of FIGS. 1A-1D, 2A & 2B, FIGS. 8A & 8B being mutually rotated by 180 degrees.
Figure 8B:
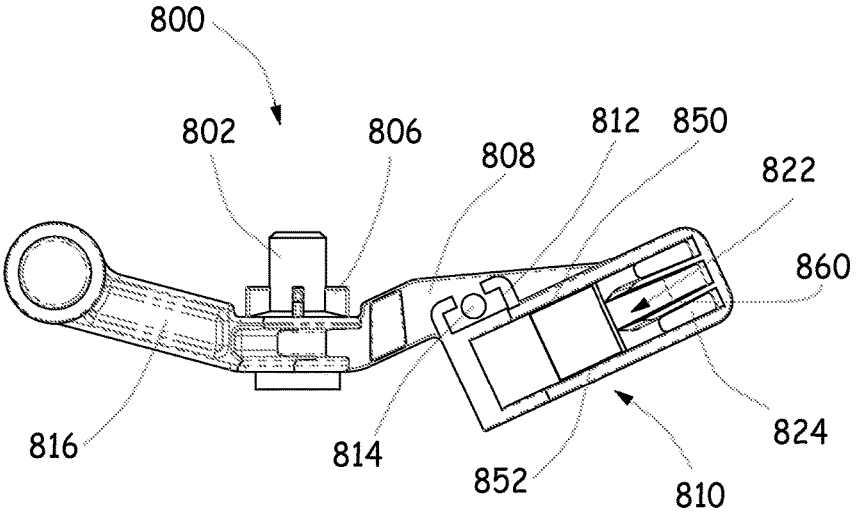
Figure 8C:
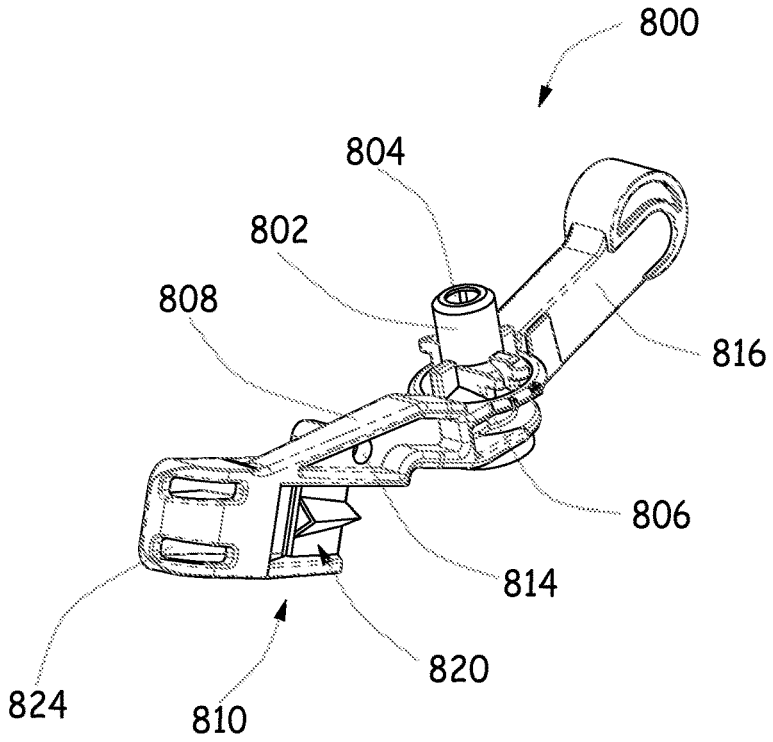
FIGS. 8C and 8D are simplified isometric illustrations of the hammer element of FIGS. 8A and 8B, taken from two different viewpoints.
Figure 8D:
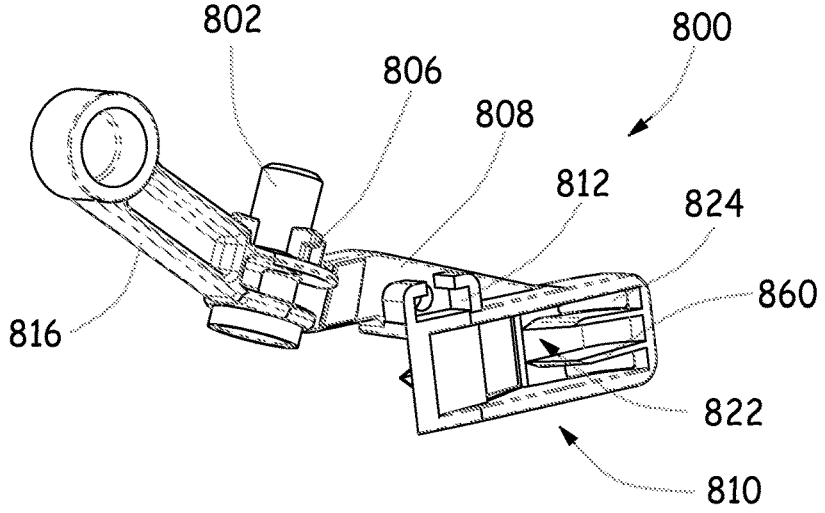
Figure 8E:
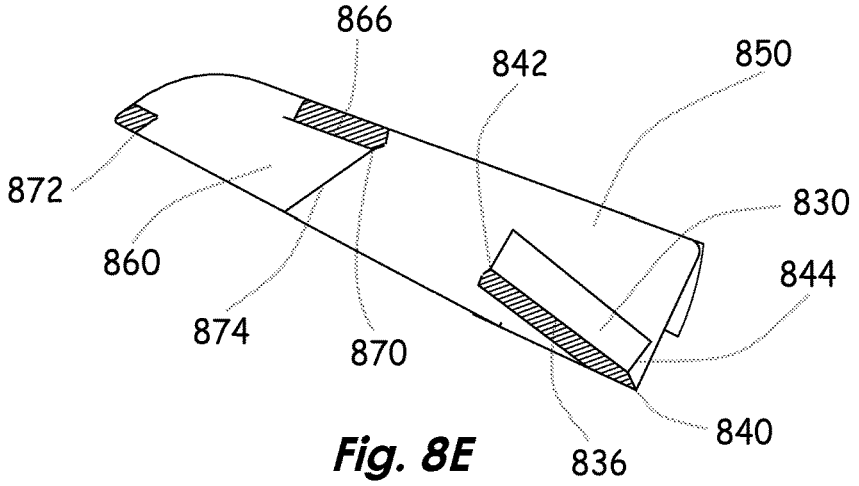
FIGS. 8E, 8F and 8G are simplified sectional illustrations taken along respective section lines E-E, F-F and G-G in FIG. 8A.
Figure 8F:
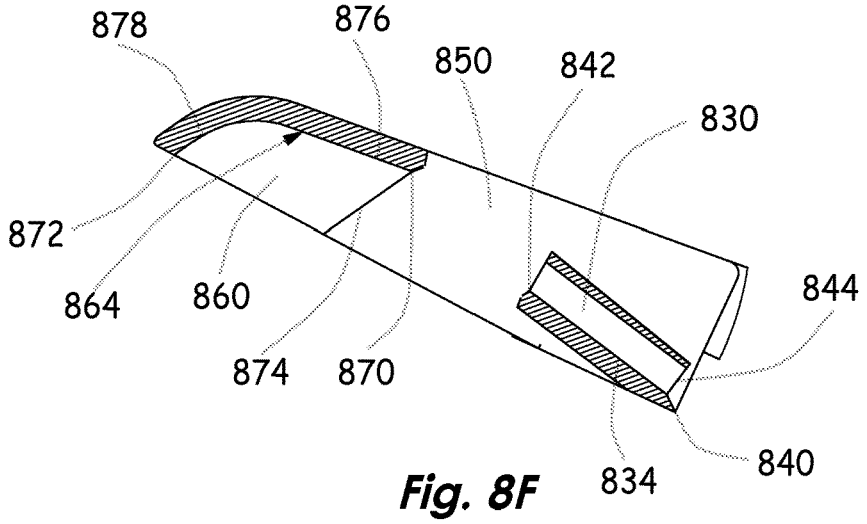
Figure 8G:
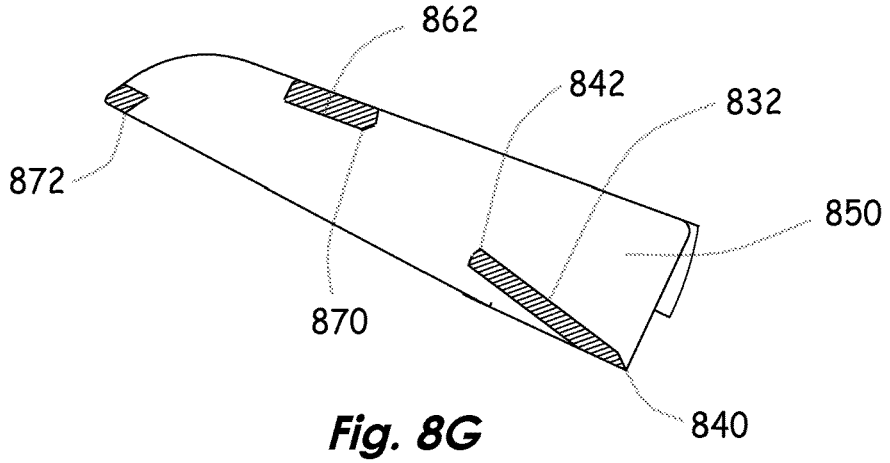
Figure 8H:
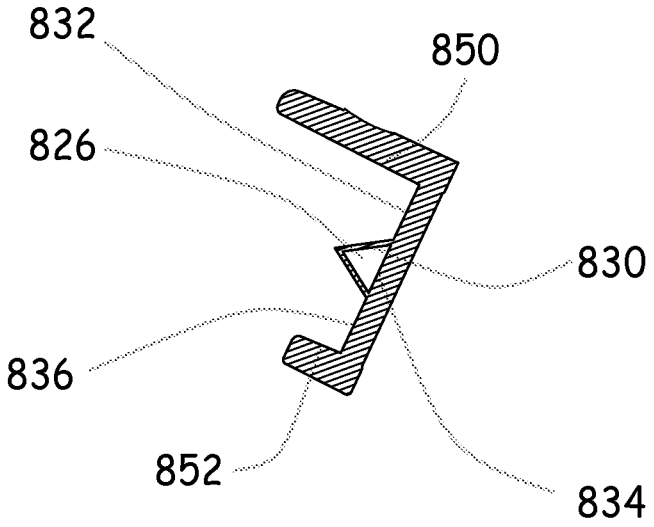
FIGS. 8H, 8I, 8J and 8K are simplified sectional illustrations taken along respective section lines H-H, I-I, J-J and K-K in FIG. 8A.
Figure 8I:
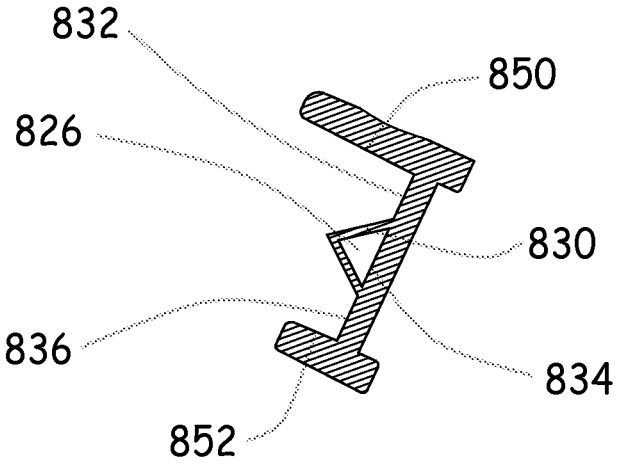
Figure 8J:
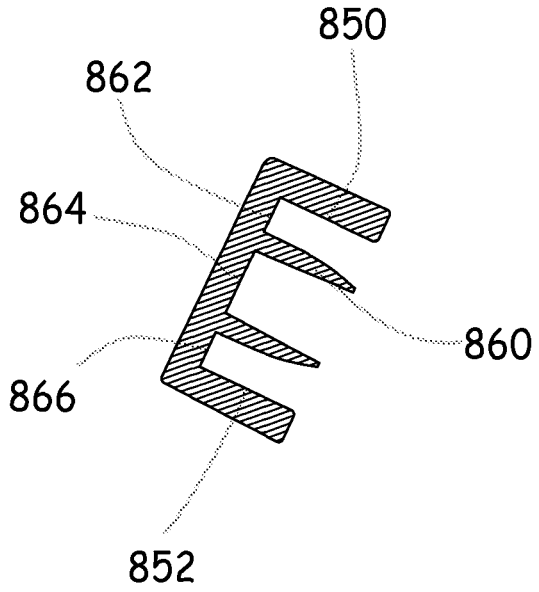
Figure 8K:
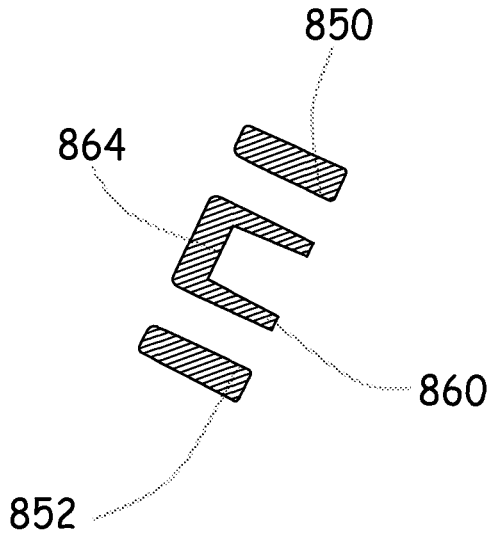

Reference is now made to FIGS. 8A and 8B, which are simplified side view illustrations of a hammer element 800 forming part of the sprinkler of FIGS. 1A-2B, FIGS. 8A & 8B being mutually rotated by 180 degrees, and to FIGS. 8C and 8D, which are simplified isometric illustrations of the hammer element of FIGS. 8A and 8B, taken from two different viewpoints. Reference is also made to FIGS. 8E, 8F and 8G, which are simplified sectional illustrations taken along respective section lines E-E, F-F and G-G in FIG. 8A, and to FIGS. 8H, 8I, 8J and 8K, which are simplified sectional illustrations taken along respective section lines H-H, I-I, J-J and K-K in FIG. 8A.

As seen in FIGS. 8A-8K, hammer 800 preferably includes a generally central hub portion 802 that defines a cylindrical sleeve portion 804 which is preferably sized to rotatably accommodate vertical hammer mounting shaft 196. Hub portion 802 also preferably defines a plurality of, typically four, spring mounting protrusions 806.

Extending generally forwardly from hub portion 802 is a deflector mounting arm 808 from which extends a deflector 810. Deflector mounting arm 808 also preferably includes an attachment recess 812 and aperture 814 for optional mounting thereon of spray diffuser 212.

Extending generally rearwardly from hub portion 802 is a balancing arm 816.

Reference is now particularly made to deflector 810 and to FIGS. 8E-8K. It is a particular feature of the present invention that deflector 810 includes a first pressurized water stream engagement surface 820, which receives a water stream from the forward nozzle 190, and a second pressurized water stream engagement surface 822, downstream of the first pressurized water stream engagement surface 820, wherein the first pressurized water stream engagement surface 820 has a pressurized water stream channeling configuration arranged:

to direct a first portion of the pressurized water stream impinging on the first pressurized water stream engagement surface 820, which does not exceed a predetermined water stream quantity, onto the second pressurized water stream engagement surface 822, and to direct at least a second portion of the pressurized water stream impinging on the first pressurized water stream engagement surface 820, which second portion exceeds the predetermined water stream quantity, not onto the second pressurized water stream engagement surface 822.

Preferably, the second pressurized water stream engagement surface 822 has at least one, and typically two, water stream bypass apertures 824 formed therein and the first pressurized water stream engagement surface 820 is arranged to direct at least a second portion of the pressurized water stream impinging on the first pressurized water stream engagement surface 820 through the water stream bypass aperture or apertures 824.

It is also a particular feature of the present invention that the first pressurized water stream engagement surface 820 is preferably formed with a central water flow channel 826 of generally triangular cross section defined by two mutually inclined generally parallel-extending upstanding vanes 830, which divide surface 820 into preferably three water engagement sub-surfaces 832, 834 and 836. In the illustrated embodiment, the width of each of water engagement sub-surfaces 832, 834 and 836 is generally identical, however, alternatively, the individual sub-surfaces 832, 834 and 836 may have different widths. Alternatively, the number of vanes 830 provided may be more or less than two.

Preferably vanes 830 have increased thickness from a stream incoming edge 840 of first pressurized water stream engagement surface 820 to a stream exiting edge 842 of the first pressurized water stream engagement surface 820. Preferably vanes 830 each have a tapered stream facing edge 844.

First water stream engagement surface 820 is preferably generally flat except for a short tapered portion adjacent incoming edge 840.

Both the first and second water stream engagement surfaces 820 and 822 are defined by side walls 850 and 852, which join first and second water stream engagement surfaces 820 and 822 and define an open space therebetween.

It is a further particular feature of the present invention that the second pressurized water stream engagement surface 822 is preferably formed with two mutually spaced generally parallel upstanding vanes 860 which divide surface 822 into preferably three water engagement sub-surfaces 862, 864 and 866.

In the illustrated embodiment, the width of each of water engagement sub-surfaces 862, 864 and 866 is generally identical, however, alternatively, the individual sub-surfaces 862, 864 and 866 may have different widths. Alternatively, the number of vanes 860 provided may be more or less than two.

Preferably vanes 860 have a generally uniform thickness from a stream incoming edge 870 of second pressurized water stream engagement surface 822 to a stream exiting edge 872 of the second pressurized water stream engagement surface 822. Preferably vanes 860 each have a tapered stream facing edge 874.

Second water stream engagement surface 822 is preferably generally curved, faces generally oppositely to first water stream engagement surface 820 and includes a generally flat portion 876 adjacent incoming edge 870, which extend into a generally curved portion 878, adjacent stream exiting edge 872.

It is an additional particular feature of the present invention that preferably water engagement sub-surfaces 862 and 866, on opposite sides of water engagement sub-surface 864, are formed with apertures extending nearly all along generally curved portion 878 and preferably along a downstream part of flat portion 876.

Figure 9A:
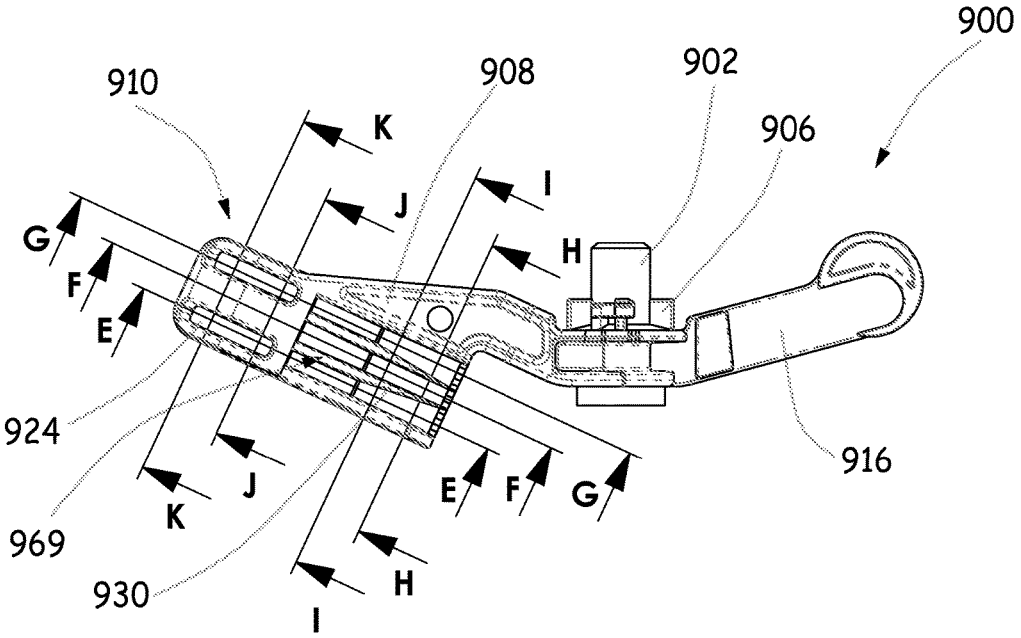
FIGS. 9A and 9B are simplified side view illustrations of still another hammer element suitable for forming part of the sprinkler of FIGS. 1A-1D, 2A & 2B, FIGS. 9A & 9B being mutually rotated by 180 degrees.
Figure 9B:
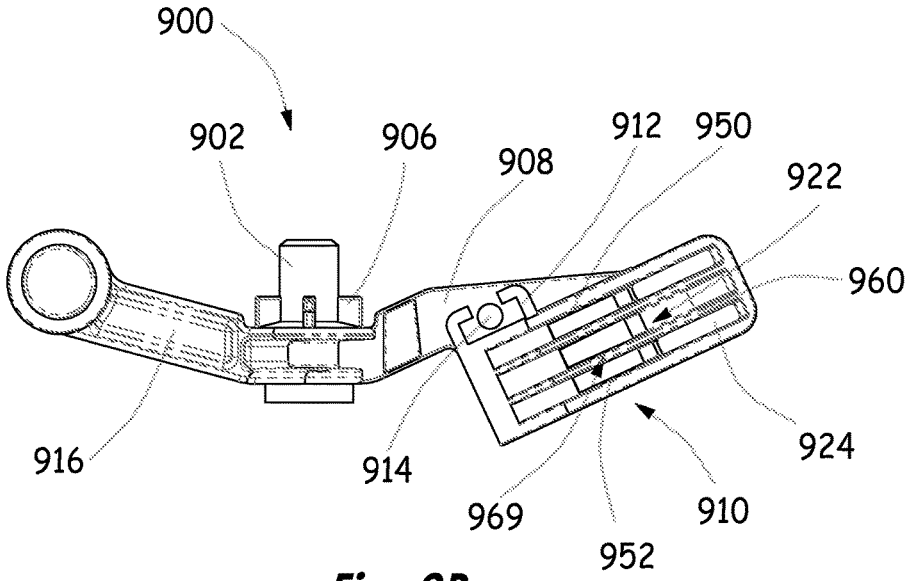
Figure 9C:
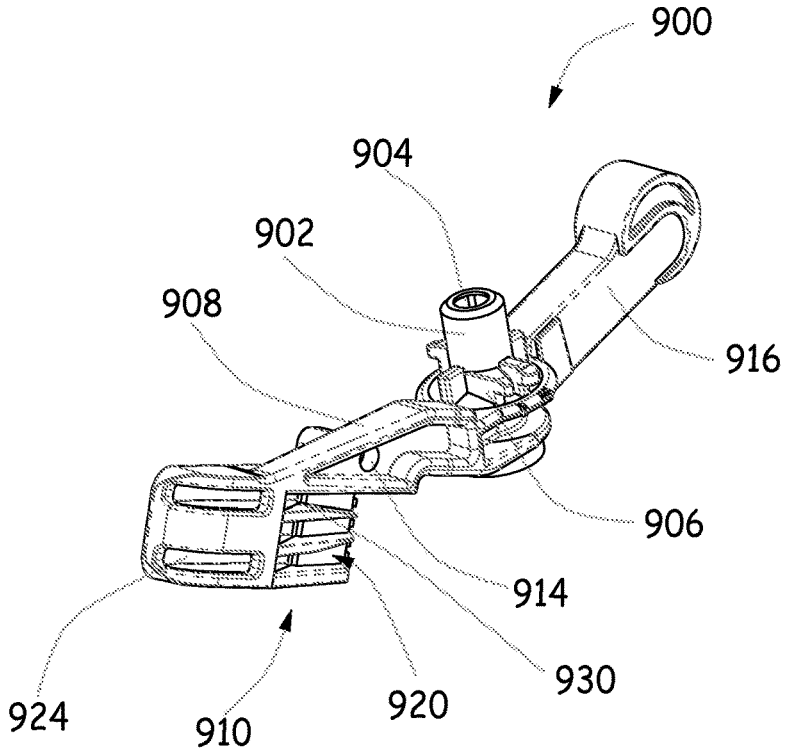
FIGS. 9C and 9D are simplified isometric illustrations of the hammer element of FIGS. 9A and 9B, taken from two different viewpoints.
Figure 9D:
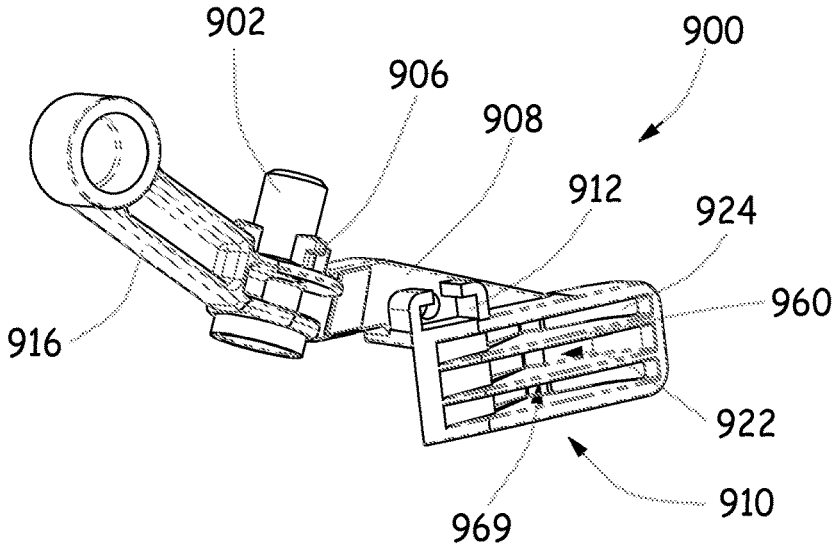
Figure 9E:
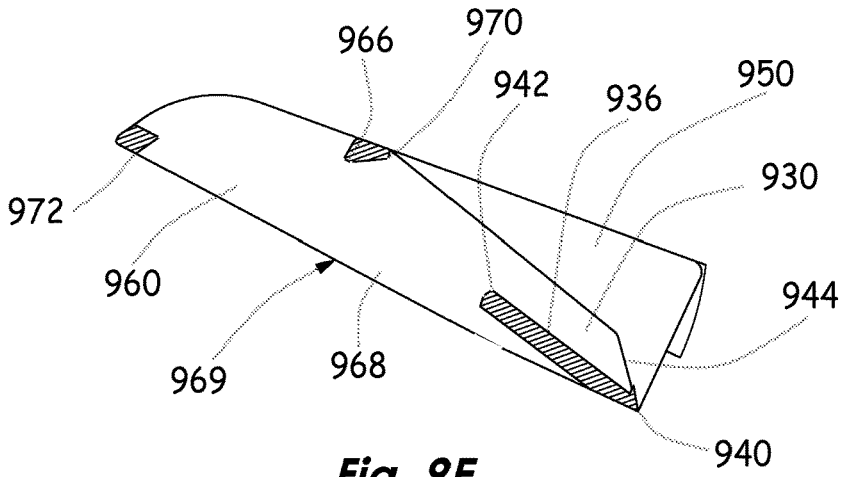
FIGS. 9E, 9F and 9G are simplified sectional illustrations taken along respective section lines E-E, F-F and G-G in FIG. 9A.
Figure 9F:
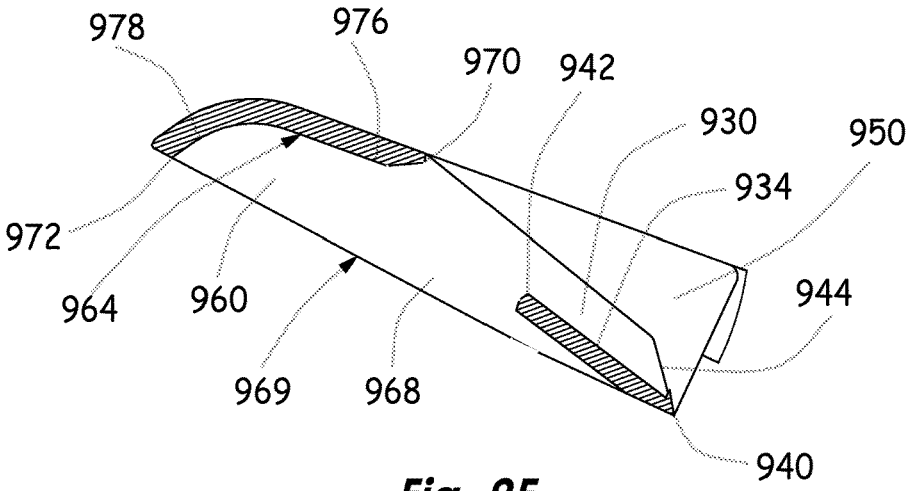
Figure 9G:
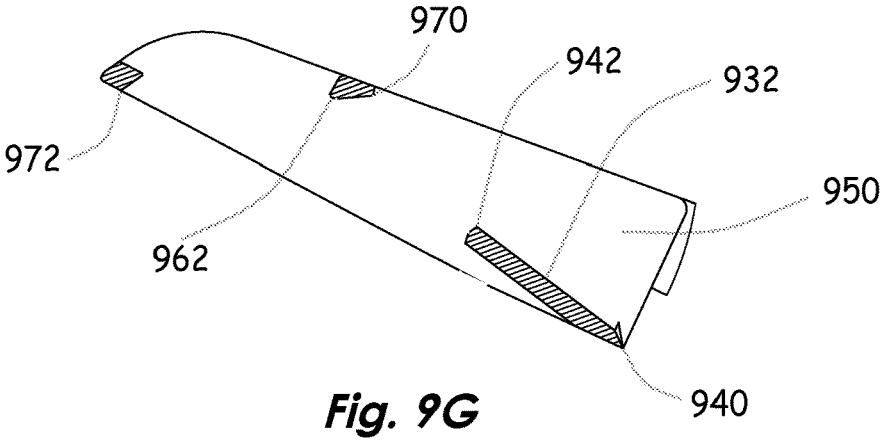
Figure 9H:
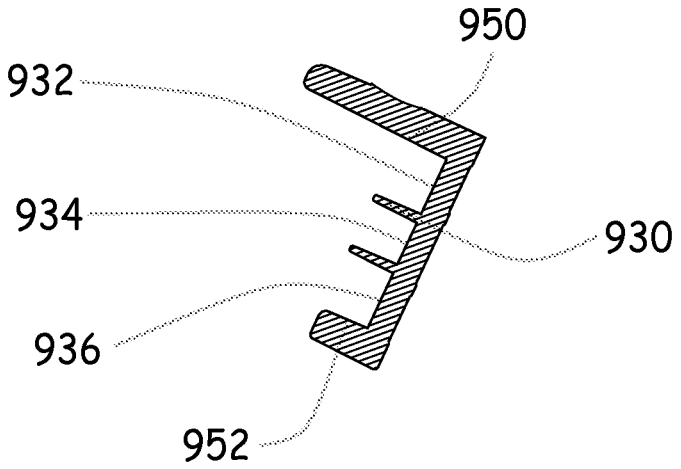
FIGS. 9H, 9I, 9J and 9K are simplified sectional illustrations taken along respective section lines H-H, I-I, J-J and K-K in FIG. 9A.
Figure 9I:
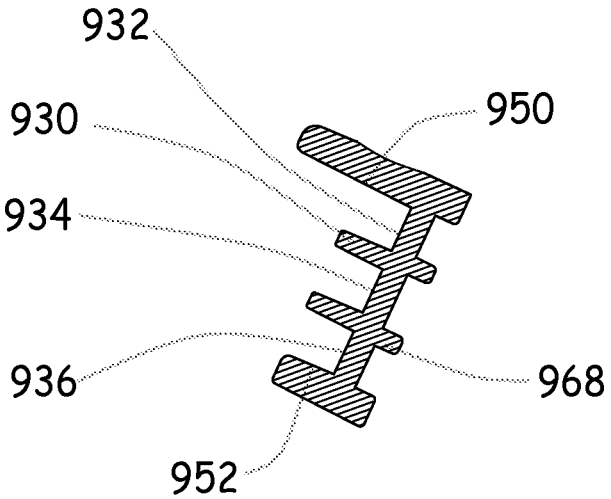
Figure 9J:
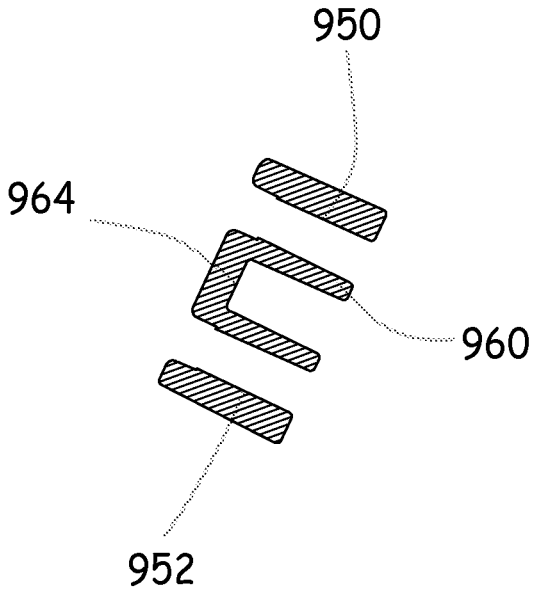
Figure 9K:
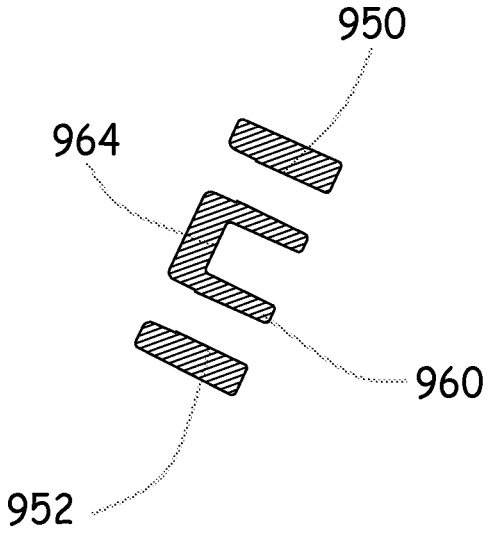

Reference is now made to FIGS. 9A and 9B, which are simplified side view illustrations of a hammer element 900 forming part of the sprinkler of FIGS. 1A-2B, FIGS. 9A & 9B being mutually rotated by 180 degrees, and to FIGS. 9C and 9D, which are simplified isometric illustrations of the hammer element of FIGS. 9A and 9B, taken from two different viewpoints. Reference is also made to FIGS. 9E, 9F and 9G, which are simplified sectional illustrations taken along respective section lines E-E, F-F and G-G in FIG. 9A, and to FIGS. 9H, 9I, 9J and 9K, which are simplified sectional illustrations taken along respective section lines H-H, I-I, J-J and K-K in FIG. 9A.

As seen in FIGS. 9A-9K, hammer 900 preferably includes a generally central hub portion 902 that defines a cylindrical sleeve portion 904 which is preferably sized to rotatably accommodate vertical hammer mounting shaft 196. Hub portion 902 also preferably defines a plurality of, typically four, spring mounting protrusions 906.

Extending generally forwardly from hub portion 902 is a deflector mounting arm 908 from which extends a deflector 910. Deflector mounting arm 908 also preferably includes an attachment recess 912 and aperture 914 for optional mounting thereon of spray diffuser 212.

Extending generally rearwardly from hub portion 902 is a balancing arm 916.

Reference is now particularly made to deflector 910 and to FIGS. 9E-9K. It is a particular feature of the present invention that deflector 910 includes a first pressurized water stream engagement surface 920, which receives a water stream from the forward nozzle 190, and a second pressurized water stream engagement surface 922, downstream of the first pressurized water stream engagement surface 920, wherein the first pressurized water stream engagement surface 920 has a pressurized water stream channeling configuration arranged:

to direct a first portion of the pressurized water stream impinging on the first pressurized water stream engagement surface 920, which does not exceed a predetermined water stream quantity, onto the second pressurized water stream engagement surface 922, and to direct at least a second portion of the pressurized water stream impinging on the first pressurized water stream engagement surface 920, which second portion exceeds the predetermined water stream quantity, not onto the second pressurized water stream engagement surface 922.

Preferably, the second pressurized water stream engagement surface 922 has at least one, and typically two, water stream bypass apertures 924 formed therein and the first pressurized water stream engagement surface 920 is arranged to direct at least a second portion of the pressurized water stream impinging on the first pressurized water stream engagement surface 920 through the water stream bypass aperture or apertures 924.

It is also a particular feature of the present invention that the first pressurized water stream engagement surface 920 is preferably formed with two, mutually spaced generally parallel upstanding vanes 930, having parallel mutually facing surfaces and non parallel opposite surfaces, which divide surface 920 into preferably three water engagement sub-surfaces 932, 934 and 936. In the illustrated embodiment, the width of each of water engagement sub-surfaces 932, 934 and 936 is generally identical, however, alternatively, the individual sub-surfaces 932, 934 and 936 may have different widths. Alternatively, the number of vanes 930 provided may be more or less than two.

Preferably vanes 930 have a generally truncated triangular cross section and have increased thickness from a stream incoming edge 940 of first pressurized water stream engagement surface 920 to a stream exiting edge 942 of the first pressurized water stream engagement surface 920. Preferably vanes 930 each have a tapered stream facing edge 944.

First water stream engagement surface 920 is preferably generally flat except for a short tapered portion adjacent incoming edge 940.

Both the first and second water stream engagement surfaces 920 and 922 are defined by side walls 950 and 952, which join first and second water stream engagement surfaces 920 and 922 and define an open space therebetween.

It is a further particular feature of the present invention that the second pressurized water stream engagement surface 922 is preferably formed with two mutually spaced generally parallel upstanding vanes 960 which divide surface 922 into preferably three water engagement sub-surfaces 962, 964 and 966. It is a particular feature of the embodiment of FIGS. 9A-9K, that vanes 960 are formed as continuations of vanes 930, such that vanes 930 of the first pressurized water stream engagement surface 920, vanes 960 of the second pressurized water stream engagement surface 922 and intermediate vanes 968, each joining a vane 930 with a vane 960, together define continuous vanes 969, spanning both first and second pressurized water stream engagement surfaces 920 and 922.

In the illustrated embodiment, the width of each of water engagement sub-surfaces 962, 964 and 966 is generally identical, however, alternatively, the individual sub-surfaces 962, 964 and 966 may have different widths. Alternatively, the number of vanes 960 provided may be more or less than two.

Preferably vanes 960 have a generally uniform thickness from a stream incoming edge 970 of second pressurized water stream engagement surface 922 to a stream exiting edge 972 of the second pressurized water stream engagement surface 922.

Second water stream engagement surface 922 is preferably generally curved, faces generally oppositely to first water stream engagement surface 920 and includes a generally flat portion 976 adjacent incoming edge 970, which extend into a generally curved portion 978, adjacent stream exiting edge 972.

It is an additional particular feature of the present invention that preferably water engagement sub-surfaces 962 and 966, on opposite sides of water engagement sub-surface 964, are formed with apertures extending nearly all along generally curved portion 978 and preferably along a downstream part of flat portion 976.

Figure 10A:
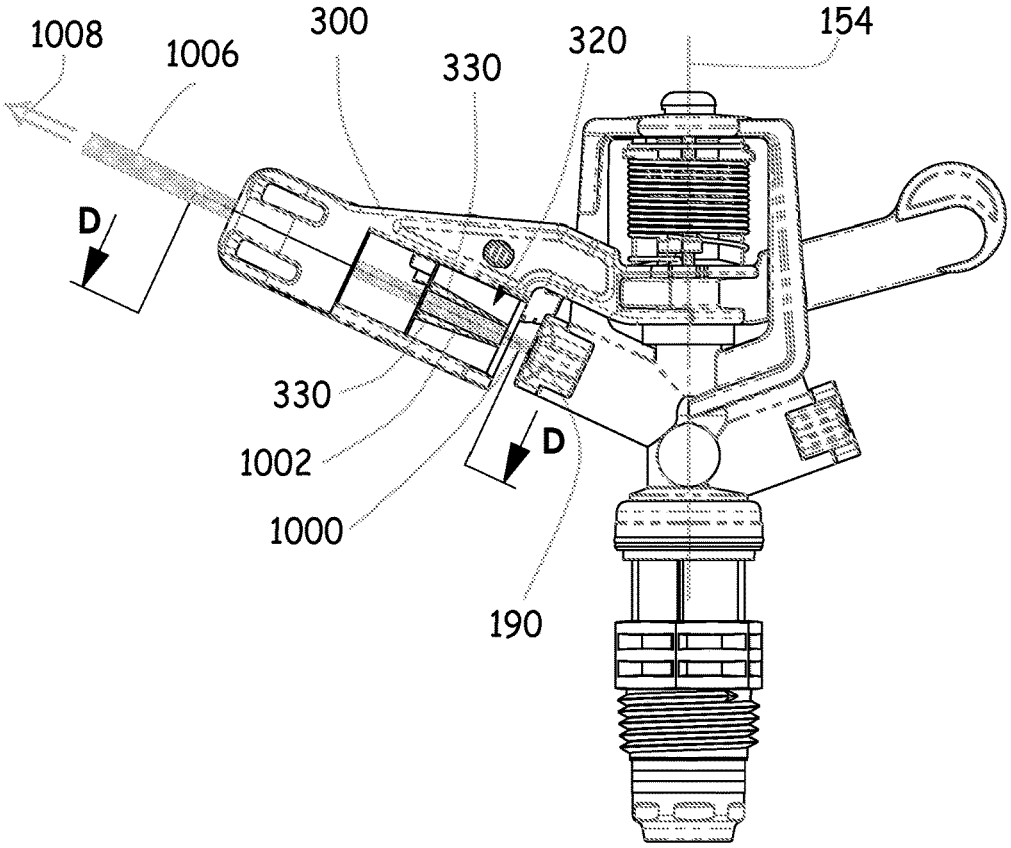
FIGS. 10A, 10B & 10C are respective simplified front view, top view and back view illustrations of the sprinkler of FIGS. 1A-3B, showing water flows therethrough when a relatively small nozzle is employed.
Figure 10B:
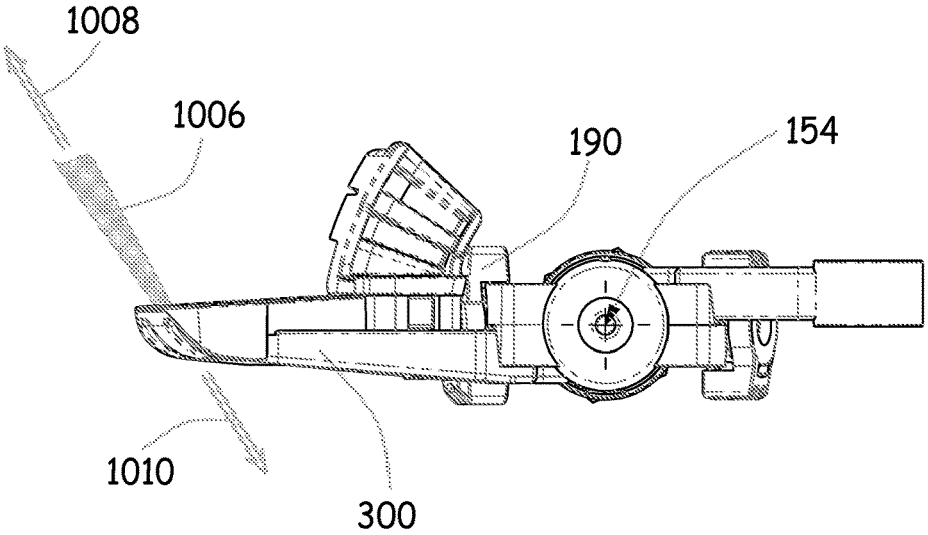
Figure 10C:
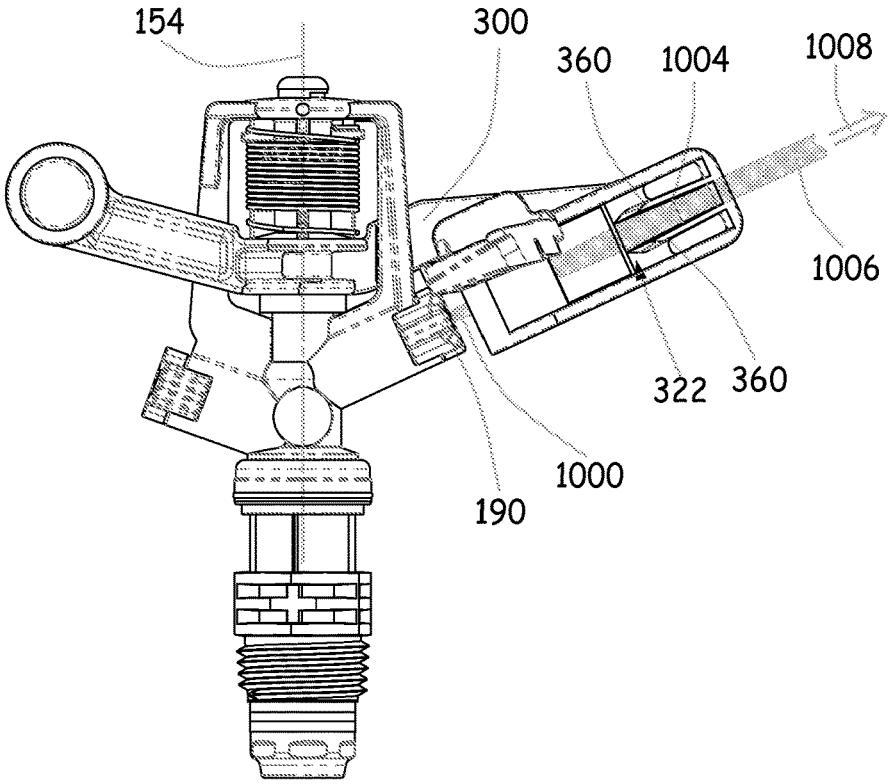
Figure 10D:
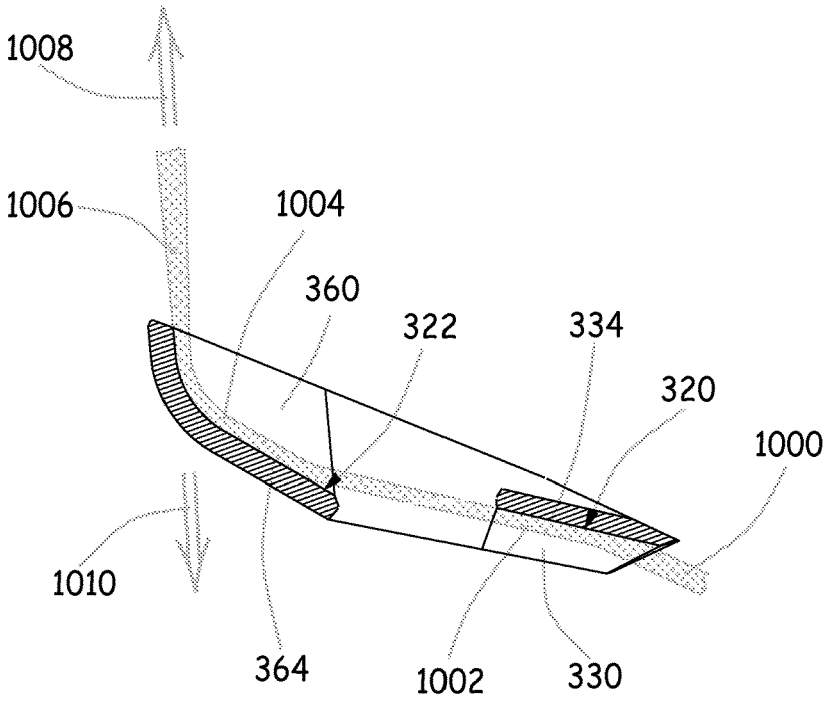
FIG. 10D is a simplified sectional illustration taken along lines D-D in FIG. 10A.

Reference is now made to FIGS. 10A, 10B & 10C, which are respective simplified front view, top view and back view illustrations of the sprinkler of FIGS. 1A-3D, showing water flows therethrough when a relatively small nozzle is employed, and to FIG. 10D, which is a simplified sectional illustration taken along lines D-D in FIG. 10A.

As seen in FIGS. 10A-10D, in the illustrated embodiment, when a relatively small forward nozzle is employed, such as a nozzle 190 having an internal diameter of 2 mm, nearly all of the water stream emanating from nozzle 190, here designated by reference numeral 1000, is confined between vanes 330 of first water stream engagement surface 320 in engagement with first water engagement sub-surface 334, as designated by reference numeral 1002. Nearly all of the water stream then impinges on second water engagement sub-surface 364, and is confined between vanes 360 of the second water stream engagement surface 322, as designated by reference numeral 1004. Nearly all of the water stream as designated by reference numeral 1006 exits in a direction indicated by an arrow 1008. Accordingly, nearly all of the water stream applies a rotational force, indicated by an arrow 1010, to hammer 300, causing it to rotate about vertical axis 154.

Figure 11A:
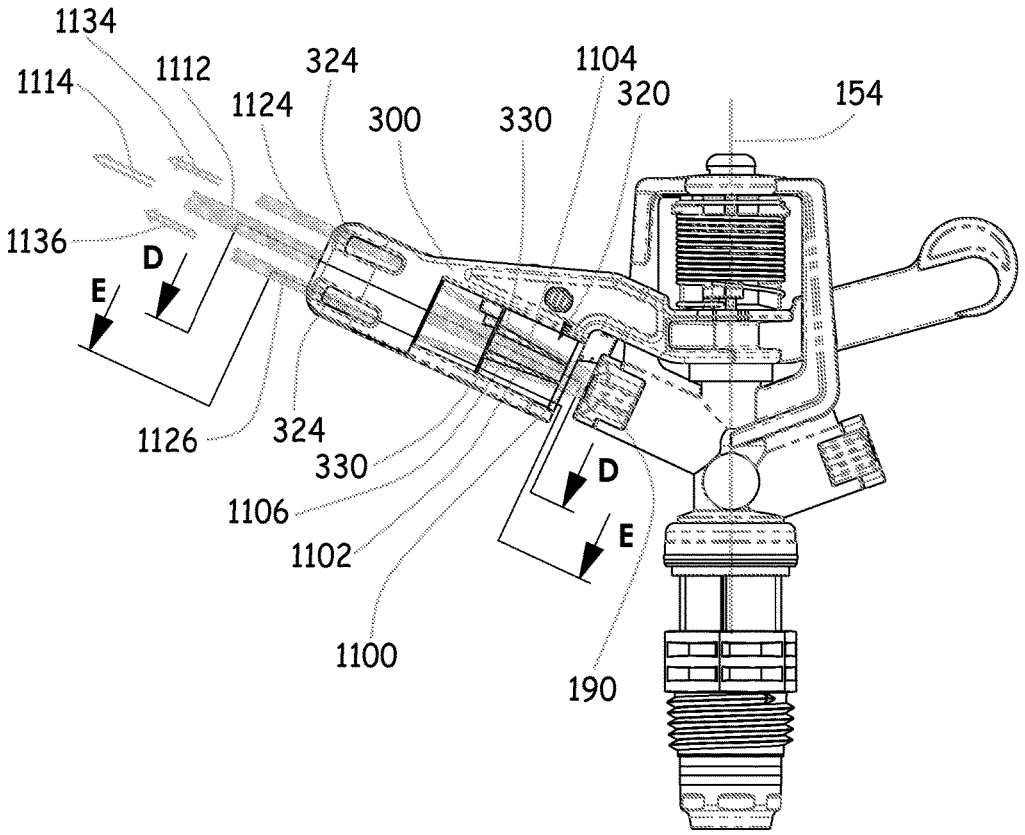
FIGS. 11A, 11B & 11C are respective simplified front view, top view and back view illustrations of the sprinkler of FIGS. 1A-3B, showing water flows therethrough when a relatively small nozzle is employed.
Figure 11B:
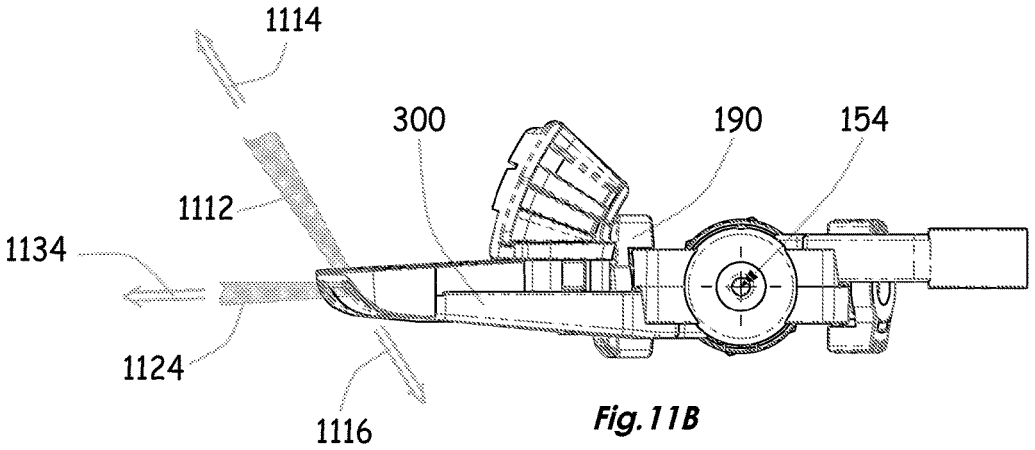
Figure 11C:
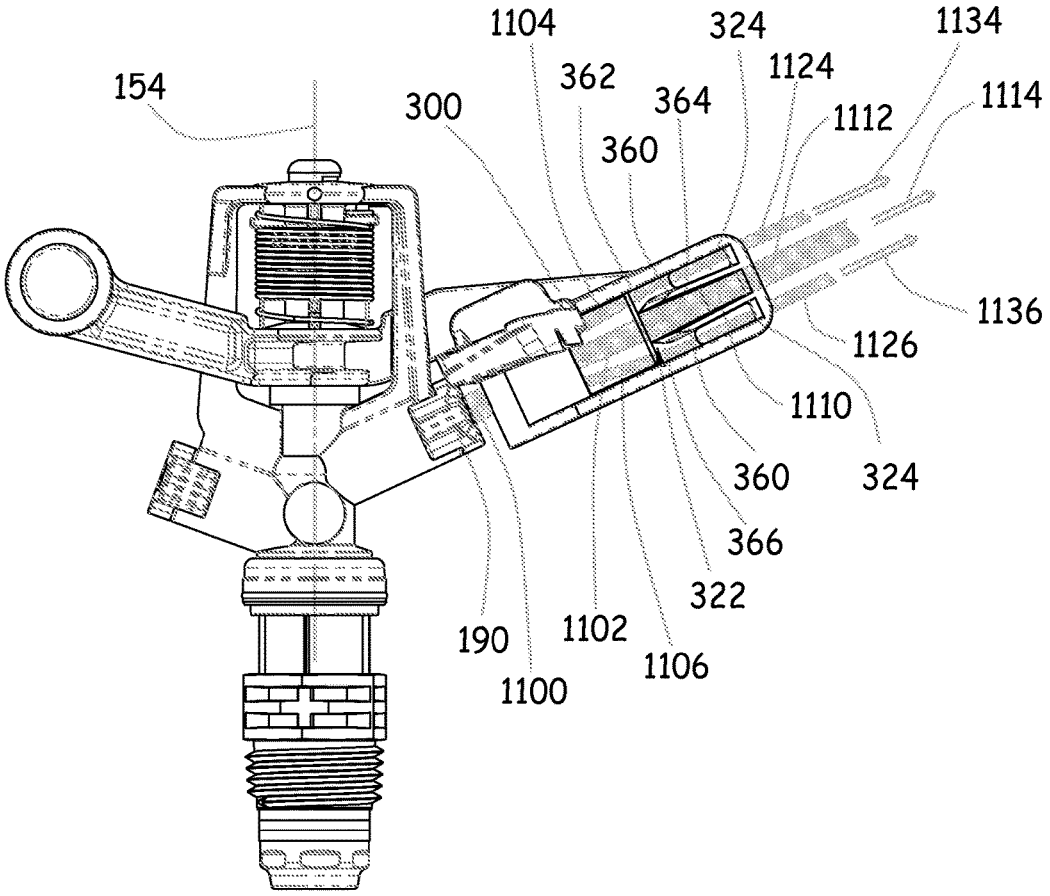
Figure 11D:
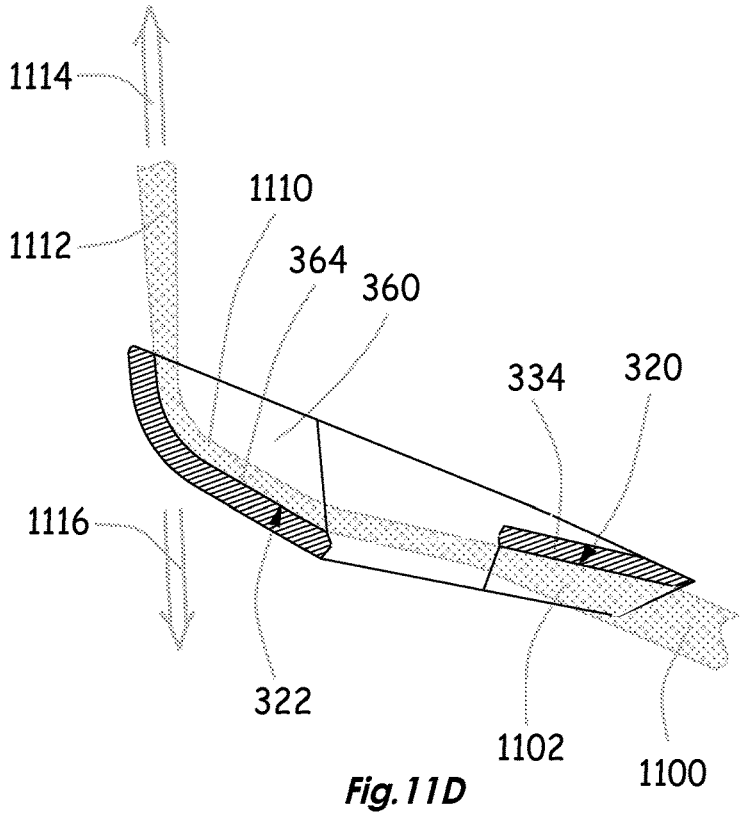
FIG. 11D is a simplified sectional illustration taken along lines D-D in FIG. 11A.
Figure 11E:
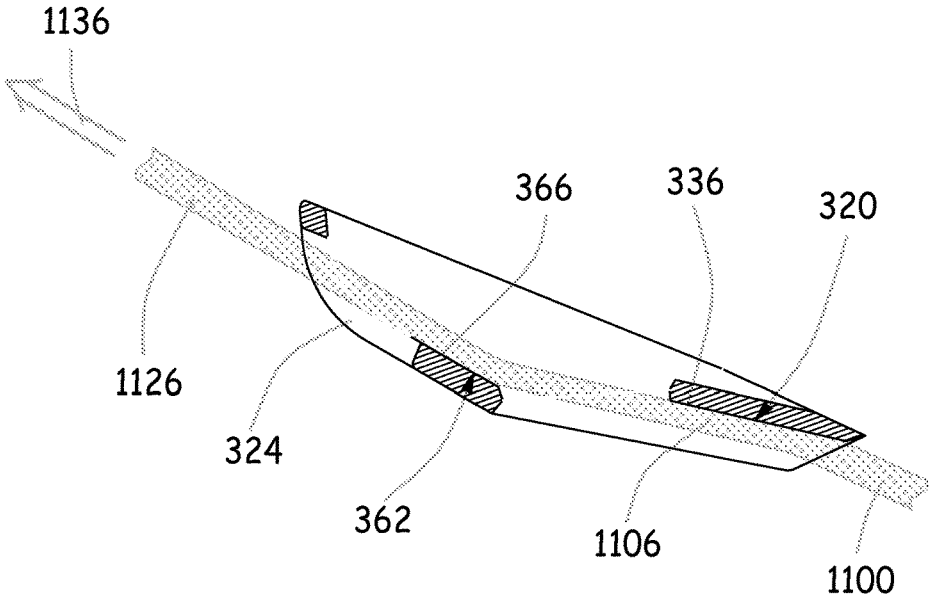
FIG. 11E is a simplified sectional illustration taken along lines E-E in FIG. 11A.

Reference is now made to FIGS. 11A, 11B & 11C, which are respective simplified front view, top view and back view illustrations of the sprinkler of FIGS. 1A-3D, showing water flows therethrough when a relatively large nozzle is employed, to FIG. 11D, which is a simplified sectional illustration taken along lines D-D in FIG. 11A, and to FIG. 11E, which is a simplified sectional illustration taken along lines E-E in FIG. 11A.

As seen in FIGS. 11A-11E, in the illustrated embodiment, when a relatively large forward nozzle is employed, such as a nozzle 190 having an internal diameter of 5 mm, a water stream 1100 emanates from nozzle 190. In accordance with a preferred embodiment of the present invention, only part of water stream 1100, here designated by reference numeral 1102, is confined between vanes 330 of first water stream engagement surface 320 in engagement with first water engagement sub-surface 334.

Two side water streams, respectively designated by reference numerals 1104 and 1106, flow outside vanes 330 in engagement with respective first water engagement sub-surfaces 332 and 336.

Nearly all of the water stream 1102 impinges on second water engagement sub-surface 364, and is confined between vanes 360 of the second water stream engagement surface 322, as designated by reference numeral 1110. Nearly all of the water stream 1110 exits, as designated by reference numeral 1112, in a direction indicated by an arrow 1114. Accordingly, nearly all of the water stream 1112 applies a rotational force, indicated by an arrow 1116, to hammer 300, causing it to rotate about vertical axis 154.

The two side water streams 1104 and 1106 generally do not impinge on the second water engagement surface 364 but rather exit, as respectively designated by reference numerals 1124 and 1126, through apertures 324 in directions respectively indicated by arrows 1134 and 1136. The side water streams generally do not apply a rotational force to hammer 300.

It is a particular feature of an embodiment of the present invention that, as appreciated from a comparison of FIGS. 10A-10D with FIGS. 11A-11E, it is seen that the proportion of the water stream output from the forward nozzle, which applies a rotational force to hammer 300 varies as a function of the size of the forward nozzle and thus of the discharge volume of the nozzle.

It will be appreciated by persons skilled in the art that the present invention is not limited to what has been particularly shown and described hereinabove. Rather the scope of the invention includes both combinations and subcombinations of the various features described hereinabove as well as modifications and variations thereof which would occur to persons skilled in the art upon reading the foregoing description and which are not in the prior art.

The invention claimed is:

1. An irrigation sprinkler comprising:

a base defining an axis;

a pressurized water inlet mounted onto said base;

a nozzle, communicating with said inlet, and providing a pressurized water stream which is generally outwardly directed relative to said axis; and a water stream deflector for engaging said pressurized water stream from said nozzle and deflecting at least part of said water stream generally azimuthally with respect to said axis, said water stream deflector comprising a first pressurized water stream engagement surface and a second pressurized water stream engagement surface downstream of said first pressurized water stream engagement surface, said first pressurized water stream engagement surface having a pressurized water stream directing configuration and being arranged:

to direct a first portion of said pressurized water stream impinging on said first pressurized water stream engagement surface onto said second pressurized water stream engagement surface, and to direct at least a second portion of said pressurized water stream impinging on said first pressurized water stream engagement surface not onto said second pressurized water stream engagement surface, said second pressurized water stream engagement surface being configured to be impinged upon generally only by said first portion of said pressurized water stream, said first pressurized water stream engagement surface including at least one vane which divides said pressurized water stream into said first portion of said pressurized water stream and said at least a second portion of said pressurized water stream;

said second pressurized water stream engagement surface having at least one water stream bypass aperture formed therein by at least one vane;

said first pressurized water stream engagement surface being arranged to direct said at least a second portion of said pressurized water stream impinging on said first pressurized water stream engagement surface through said at least one water stream bypass aperture; and said at least one vane which defines said at least one water stream bypass aperture and said at least one vane which divides said pressurized water stream on said first pressurized water stream engagement surface being formed as generally collinear continuations of each other.

2. An irrigation sprinkler according to claim 1 and wherein said pressurized water stream directing configuration of said first pressurized water stream engagement surface includes at least one channel through which passes said pressurized water stream.

3. An irrigation sprinkler according to claim 2 and wherein said at least one channel comprises a pair of vanes which are joined by an integrally formed top plate.

4. An irrigation sprinkler according to claim 2 and wherein said at least one channel has an at least partially curved cross section.

5. An irrigation sprinkler according to claim 2 and wherein said at least one channel has a triangular cross section.

6. An irrigation sprinkler according to claim 1 and also comprising at least one intermediate vane spanning both said first and said second pressurized water stream engagement surfaces and joining said at least one vane which define said at least one water stream bypass aperture and said at least one vane which divides said pressurized water stream on said first pressurized water stream engagement surface.

7. An irrigation sprinkler according to claim 1 and wherein said second pressurized water stream engagement surface downstream of said first pressurized water stream engagement surface is curved.

8. An irrigation sprinkler according to claim 1 and wherein said first pressurized water stream engagement surface is planar and said second pressurized water stream engagement surface downstream of said first pressurized water stream engagement surface is curved.

* * * * *